US009334701B1

(12) United States Patent
Carr et al.

(10) Patent No.: US 9,334,701 B1
(45) Date of Patent: May 10, 2016

(54) SYSTEMS AND METHODS FOR PRODUCTION ZONE CONTROL

(71) Applicants: Dee A. Carr, Snyder, TX (US); Jerry Pechacek, Snyder, TX (US)

(72) Inventors: Dee A. Carr, Snyder, TX (US); Jerry Pechacek, Snyder, TX (US)

(73) Assignee: SOAR Tools, LLC, Snyder, TX (US)

( * ) Notice: Subject to any disclaimer, the term of this patent is extended or adjusted under 35 U.S.C. 154(b) by 0 days.

(21) Appl. No.: 14/252,224

(22) Filed: Apr. 14, 2014

Related U.S. Application Data

(63) Continuation-in-part of application No. 13/623,762, filed on Sep. 20, 2012, now Pat. No. 9,033,031.

(60) Provisional application No. 61/549,666, filed on Oct. 20, 2011.

(51) Int. Cl.
*E21B 23/03* (2006.01)

(52) U.S. Cl.
CPC ..... *E21B 23/03* (2013.01)

(58) Field of Classification Search
CPC ..... E21B 23/02; E21B 7/061; E21B 23/01; E21B 23/03; E21B 34/14; E21B 41/10
USPC ..... 166/117.5, 123, 313, 382
See application file for complete search history.

(56) References Cited

U.S. PATENT DOCUMENTS 3,052,309 A * 9/1962 Eastman ..... 175/45
3,062,287 A * 11/1962 Hayes ..... 166/354
3,450,205 A * 6/1969 Current ..... 166/189
3,556,212 A 1/1971 Vazquez et al.
3,934,648 A * 1/1976 Amancharla et al. ..... 166/116
4,031,954 A * 6/1977 Herbert et al. ..... 166/117.5
4,043,390 A 8/1977 Glotin
4,171,934 A 10/1979 Zehren
4,440,221 A 4/1984 Taylor et al.
4,477,104 A 10/1984 Akkerman
4,749,341 A 6/1988 Bayh, III
4,756,364 A 7/1988 Christensen et al.
4,765,403 A 8/1988 Crawford et al.
4,823,872 A 4/1989 Hopmann
4,883,120 A 11/1989 Schasteen et al.
4,913,239 A 4/1990 Bayh, III
5,318,132 A * 6/1994 Odorisio ..... 166/382
5,374,163 A 12/1994 Jaikaran
5,503,224 A 4/1996 Field
5,704,425 A * 1/1998 Divis et al. ..... 166/191

(Continued)

OTHER PUBLICATIONS

Baker Hughes, Flow Control Systems catalog, 2010.

*Primary Examiner* — Daniel P Stephenson
(74) *Attorney, Agent, or Firm* — John G. Fischer, Esq.; Jaspal S. Hare, Esq.; Scheef & Stone, L.L.P.

(57) ABSTRACT

An improved downhole well control tool ("WCT") allows for the control of in-situ fluid flow from a production well having one or more production zones. The WCT is installed in a tubing string in a zone to be controlled. A ported seal stem having an orifice of a size and shape to provide the desired choking is seated in the WCT using wireline tools to allow for the production of oil and/or gas. The WCT has an orientation sleeve that causes the seal stem to rotate and align the orifice with a port in the WCT. The seal stem may be removed to fully-open the port of WCT for injection operations, or a non-ported seal stem may be seated in the WCT to seal off the zone. WCTs of different diameters allow for multiple zones to be controlled.

19 Claims, 17 Drawing Sheets

(56) References Cited

U.S. PATENT DOCUMENTS

| | | | | |
|---|---|---|---|---|
| 6,260,623 | B1 * | 7/2001 | Schick | 166/313 |
| 6,298,915 | B1 * | 10/2001 | George | 166/255.2 |
| 6,926,504 | B2 | 8/2005 | Howard | |
| 7,748,449 | B2 | 7/2010 | Bussear et al. | |
| 8,517,114 | B2 | 8/2013 | Nevels et al. | |
| 2004/0137778 | A1 | 7/2004 | Mattheeuws et al. | |
| 2004/0245020 | A1 * | 12/2004 | Giroux et al. | 175/61 |
| 2011/0011646 | A1 * | 1/2011 | Giroux et al. | 175/61 |
| 2011/0042107 | A1 | 2/2011 | Chambers et al. | |

* cited by examiner

SYSTEMS AND METHODS FOR PRODUCTION ZONE CONTROL

CROSS-REFERENCE TO RELATED APPLICATIONS

The present application is a continuation-in-part of U.S. application Ser. No. 13/623,762, filed Sep. 20, 2012, which is hereby incorporated in its entirety by reference, which claims the benefit of U.S. Provisional Application No. 61/549,666, filed Oct. 20, 2011, which is also hereby incorporated in its entirety by reference.

TECHNICAL FIELD

The invention relates generally to systems and methods for use in oil and gas exploration and production and, more particularly, to systems and associated methods for controlling the flow of fluids and/or gas in a production zone of a well.

BACKGROUND OF THE INVENTION

In oil and gas exploration and production, wells are drilled in order to access the oil and gas trapped in rock formations below the surface of the Earth. A well typically consists of a borehole or wellbore (i.e., the hole drilled by the drill bit). The wellbore is lined with casing. A tubing string is inserted into the wellbore. The area between the tubing string and the casing is referred to as the annulus. A well may have one or more production zones capable of producing oil and/or gas corresponding to the various locations of the trapped oil and gas. The casing in the area of a production zone is perforated to allow oil and/or gas to flow into the annulus. Communication between the annulus and the tubing string is opened in the production zone to allow oil and/or gas to flow into the tubing string, then up to the surface. The flow of oil or gas, or rate of production, is generally determined by the size of the opening in the tubing string and the downhole pressure. Well control refers to controlling the flow of fluids and gas in the well and is extremely important as explained below.

Oil and gas is be trapped between various formations and is typically under tremendous pressure. That pressure is often more than sufficient to bring the oil and gas to the surface of the well and must be controlled. Often a well must be sealed-off or killed. For example, this is done to service downhole equipment. The well is killed by pumping in kill fluids, e.g., brine water or mud, such that the hydrostatic weight of the kill fluid creates sufficient pressure to exceed the pressure exerted by the trapped oil and gas. Where the pressure is relative low, brine water may be sufficient to control the well. However, when the pressure is relatively high, high-density mud is typically required to control the well. The pressure in the well changes over time. Often a well will require the use of different types of kill fluids over its life. To safely kill the well and prevent a blowout, the entire well must be filled with kill fluid, including the tubing string and the annulus. Conversely, the kill fluid must be removed from the tubing string once production resumes.

Conventionally, kill fluid was either pumped down the tubing string, then out the end of the tubing string, and up the annulus portion of the wellbore. Alternatively, kill fluid could be pumped down the annulus, then back up the tubing string. However, such operations could damage sensitive components attached to the end of the tube string. Moreover, certain equipment attached to the end of the tube string, such as an electronic submersible pump (ESP), prevented the flow of the heavy kill fluid between the tubing string and the annulus.

Where an ESP was connected to the end of the tubing string, often the ESP itself was used to circulate the heavy kill fluid. But, ESPs were not designed for pumping heavy kill fluids and the increased wear and tear led them to fail prematurely.

One conventional method used a sliding sleeve to allow fluids to flow between the tubing string and the annulus, which were installed near the downhole-end of the tube string. The sliding sleeve could be shifted or slid between an open and closed position using wire-line tools. However, conventional sliding sleeves had many drawbacks, which were exacerbated by the harsh conditions in which they operated. The sleeves frequently failed to fully-open or fully-close, thus ending up in a partially-open or partially-closed position. They also frequently became stuck or locked shortly after being installed in the well. To make matters worse, there was no way to determine whether the sleeve was in the fully-open/closed position or in a partially-open/closed position. This further complicated matters as pressure tests on the tubing string could not be performed as it could not be determined whether a leak was present in the tubing string or the sleeve. The sleeves still further were susceptible to tearing in half. A large amount of material had to be removed from the sleeves to create communication ports through which fluid passed. The minimal material remaining in the area of the communication ports was susceptible to wear from the high pressure fluids and debris being pumped through the communication ports. This left the sleeve vulnerable to shearing in half when the tubing string was pulled. Finally, the sleeves were extremely large and expensive to manufacture due to their size and complex design. Such problems are exacerbated when a well had multiple production zones, which each required a sliding sleeve.

Over time as oil and gas is removed from a formation, the flow of oil and gas becomes diminished and wells start to dry-up. In order to increase recovery, a number of techniques may be employed to continue production. For example, water or gas may be injected into certain wells (called injection wells) in order to force the remaining oil and gas towards nearby production wells. Again, control over the delivery of such fluids and gases is critically important.

A need therefore exists for a more reliable system of well control which is easily operated, resistant to damage, and not subject to time-consuming periods of waiting due to low confidence in downhole position. Further there is a need for a well control tool for controlling one or more production zones. Still further there is a need for a well control tool that can work in both injection wells and production wells.

SUMMARY OF THE INVENTION

The present invention provides a well control tool for circulating various fluids in a downhole environment, such as kill mud, and production fluids in an electric submersible pump, more commonly known in the field as an ESP. In a preferred embodiment, the present well control tool may comprise a tubular seal stem that can be inserted into a tubular sub-assembly. The combination of the devices allows for the circulation of fluids in a controlled manner, and may be set above a downhole ESP such that the ESP is secured off of the present well control tool, typically with the well control apparatus one joint above the ESP along a tubing string. During use, the well control tool allows for the pumping of fluids by the downhole ESP through a plurality of ports located on side walls of the tubular sub-assembly. These ports may be sealed by the insertion of the seal stem into the sub-assembly, with the seal stem secured in place by a series of latching fingers located in recesses along the sides of the seal stem. The latching fingers may be disengaged for retrieval of the seal stem, or may be sheared off in the event the latching fingers become stuck for one reason or another.

The present invention further provides for an improved well control tool. The improved well control tool comprises a tubular sub-assembly having an orientation sleeve coupled to the bottom of the tubular sub-assembly. The orientation sleeve preferably comprises a pair of peaks, each with a pair of guide slopes. A ported seal stem having a complementary set of guide slopes and a pair of orifices is provided. As the ported seal stem is seated in the tubular sub-assembly, the guide slopes of the orientation sleeve urge the guide slopes of the seal stem to rotationally align the seal stem such that the orifices are in alignment with the ports. By selecting the appropriate seal stem having orifices with the desired flow characteristics, choking may be performed. Alternatively, a non-ported seal stem may be employed to seal off a production zone. Also, by using multiple improved well control tools having different diameters, multiple production zones may be controlled.

DETAILED DESCRIPTION

Figure 1:
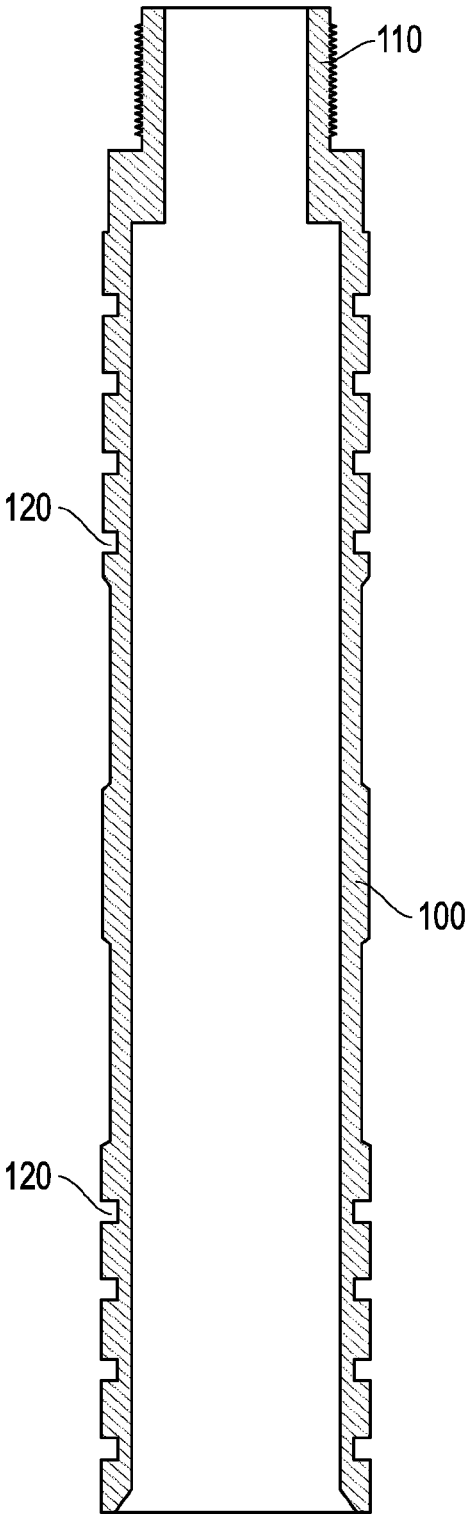
FIG. 1 is a cross-sectional view of a flow nipple illustrated in accordance with a preferred embodiment of the present invention.

Referring to FIGS. 1-18, a downhole well control tool is provided which comprises a number of discrete elements. In FIG. 1, therein is shown a cross-sectional view of a metallic flow nipple 100 which comprises a tubular structure with a plurality of exterior lateral channels 120. The plurality of lateral channels circumscribe the exterior surface of the flow nipple 100, which one of ordinary skill in the art will understand may be used for locating sealing gaskets or o-rings. Alternatively, the lateral channels 120 provide a more rigid and stable gripping surface for retrieval of the flow nipple 100 via a retrieval tool. The flow nipple 100 has a generally hollow interior with substantially smooth internal surfaces which do not impede the flow of fluid within. At a top end of the flow nipple 100, a male threaded connector 110 is provided for threaded connection to other components of the well control tool, namely a tubular lock body 200.

Figure 2:
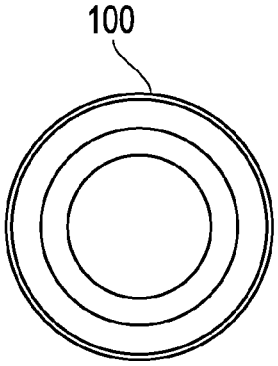
FIG. 2 is a top end view of the flow nipple of FIG. 1.

Referring next to FIG. 2, a top view of the flow nipple 100 is provided and illustrates the generally cylindrical construction of the flow nipple, with the top of the flow nipple 100 having threaded connector 110 having a generally smaller diameter than the bottom of the flow nipple 100.

Figure 3:
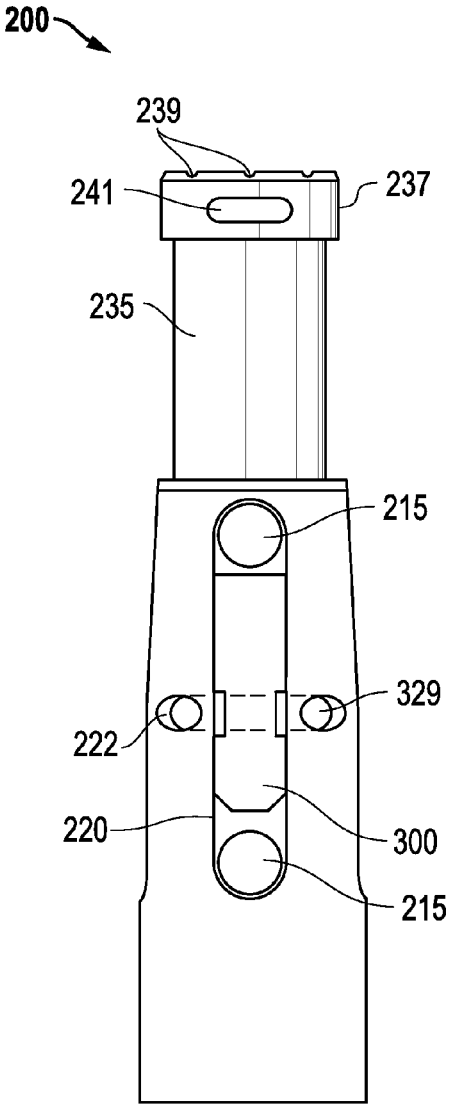
FIG. 3 is a side view of a lock body in accordance with a preferred embodiment of the present invention.

Turning to FIG. 3, a side view of a lock body 200 is shown illustrating how a latching finger 300 is inserted into a latching finger recess 220 disposed within the side of lock body 200. Lock body 200 has a pair of latching fingers 300 disposed into a pair of latching finger recesses 220, with a latching finger 300 placed on either side of lock body 200. Thus, in FIG. 3, only one of the latching finger recesses 220 is shown, with the other recess 220 on an opposite side of the lock body 200 and obstructed from view. The latching finger recesses 220 each extend along the side of the lock body 200 in a longitudinal direction and further contain through-holes 215 which extend from the exterior of lock body 200 to the interior, such that the exterior and interior are in fluid communication. The addition of through-holes 215 to the sides of the lock body 200 provides an additional area for fluid to flow through the well control tool, and further enhances the flow through and pump through capability of the tool.

The latching finger recesses 220 each further include a spring wall 224 (not shown), which provides an area for locating an end of a latch spring 327 (not shown). As shown in FIG. 3, a latching finger 300 has been located within latching finger recess 220, and is pivotally held in place within the latching finger recess 220 by way of a latching pin 329. The latching pin 329 extends first through a pin channel 222 on one side of latching finger recess 220, next through a pin channel 322 (not shown) that extends through the width of the latching finger 300, and then through a matching pin channel 222 located on an opposite side of latching finger recess 220. The use of the latching pin 329 and pin channels 222 and 322 allows for the securing of the latching finger 300 into the latching finger recess 220 as well as pivotal movement of the latching finger 300 within the latching finger recess 220. Additional details regarding the structure and function of the latching finger 300 will be further discussed below.

The lock body 200 further includes a neck 235 which provides for fluid flow through the lock body 200 and connects the primary portion of the lock body 200 with a flange 237 at the top of lock body 200. The flange 237 is essentially a protruding ridge section of the lock body 200 that allows for improved fishing and retrieval of the tool by providing a greater area for a fishing or overshot tool to latch onto or grab onto lock body 200. In a preferred embodiment of the present invention, a series of plunges 239 may be located on the top of the flange 237 to facilitate easy identification of the tool type when viewed from above. This makes it relatively easy to determine the qualities and characteristics of the tool without having to fully retrieve and extract the tool from the wellbore. Different versions of the well control tool may have different plunges or other shapes or patterns etched into the top of flange 237 to facilitate quick identification of the tool version or tool type. Flange 237 may further incorporate a pair of pinning mounts 241 (only one shown) located on either side of the flange 237, in which a running tool pin or other suitable device may be mounted thereto. While optional, the pinning mounts 241 provide additional functionality to the lock body 200 in that a greater variety of tools may be used in conjunction with the well control tool.

Figure 4:
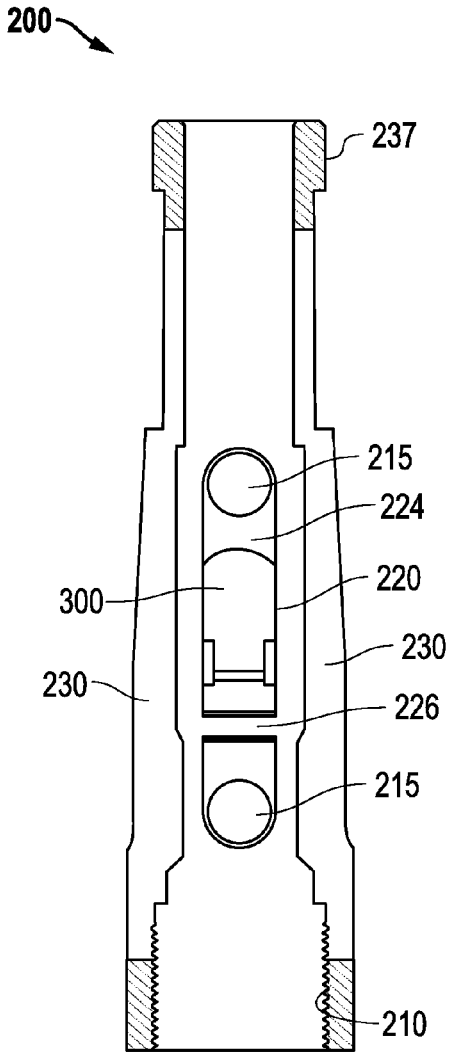
FIG. 4 is a cross-sectional view of the lock body of FIG. 3.

Next, at FIG. 4, therein is shown a cross-sectional view of the lock body 200. In the view of the well control tool shown in FIG. 4, the spring wall 224 may be more clearly seen wherein a spring located in the latching finger 300 may be pressed against the spring wall 224 to provide tension to a top end of the latching finger 300. Additionally, two flow tracks 230, which are located on opposite sides of the lock body 200 and oriented approximately 90 degrees from the latch finger recess 220 are shown extending a substantial length of the lock body 200. Specifically, in the embodiment shown in FIG. 4, flow tracks 230 extend from an area of the lock body 200 below the latch finger recesses 220 and up into the neck 235. The extended length of the flow tracks 230 provides a substantial area for fluid to flow, and further improves the flow of fluids through the well control tool in relation to other previously available tools. In conjunction with the through-holes 215, maximum flow through and pump through capability for the well control tool may be achieved. At the bottom of the lock body 200, a female threaded connector 210 may be seen. Female threaded connector 210 may be used for threaded connection to the flow nipple 100 by threaded engagement with the male threaded connector 110. By threadedly connecting the flow nipple 100 and lock body 200, a fully-assembled seal stem 400 may be formed.

Figure 5:
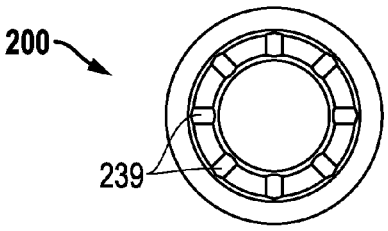
FIG. 5 is a top view of the lock body of FIG. 3.

At FIG. 5, a top view of the lock body 200 is shown, illustrating the relative diameters of the flange 237 as well as the main portion of the lock body 200. Plunges 239 are also shown as they would appear from above, illustrating the ability to quickly identify the tool based on the plunge pattern.

Figure 6:
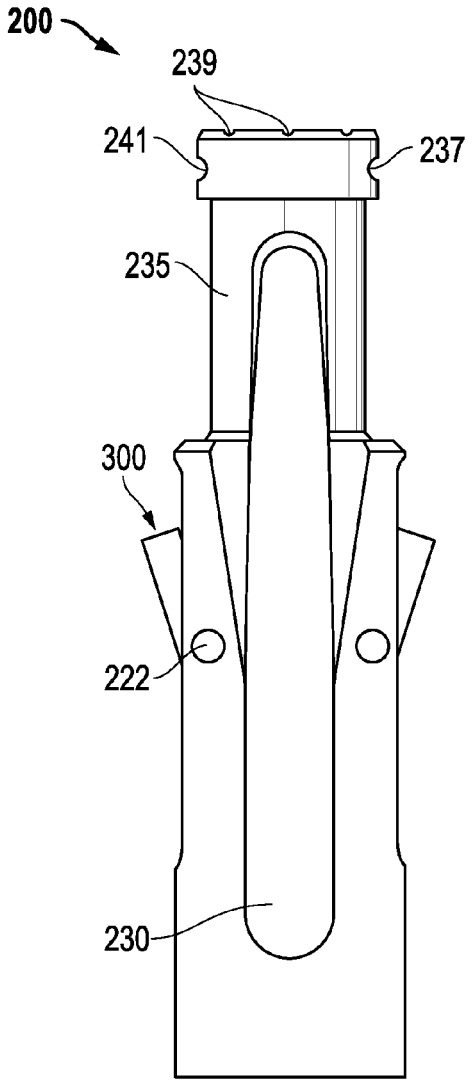
FIG. 6 is a side view of the lock body of FIG. 3 rotated 90 degrees about the longitudinal axis.
Figure 7:
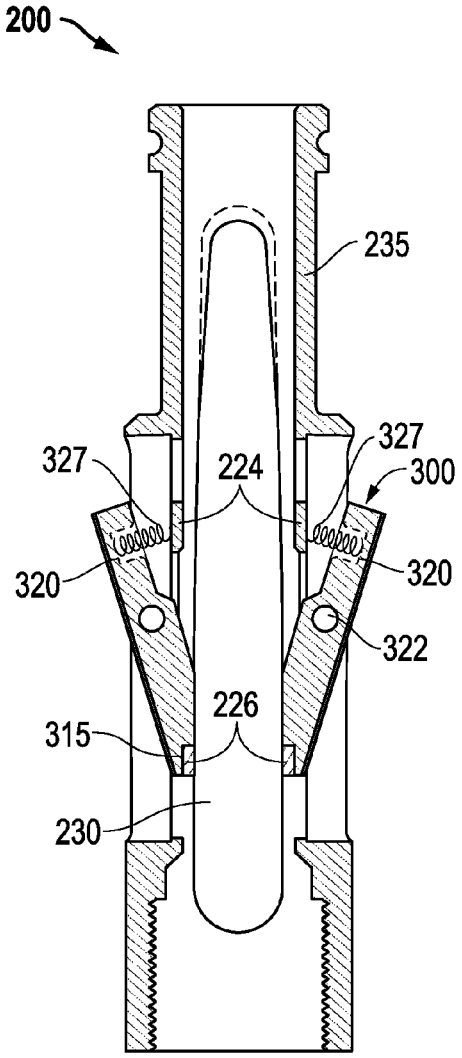
FIG. 7 is a cross-sectional view of the lock body illustrated in FIG. 6.

Referring now to FIGS. 6 and 7, the lock body 200 of FIGS. 3 and 4 has been rotated 90 degrees about its longitudinal axis. As previously described, lock body 200 comprises a pair of flow tracks 230 oriented longitudinally along the side of the lock body 200 between the latching finger recesses 220, with a flow track 230 located on opposite sides of the lock body 200. Flow tracks 230 extend from an area near the bottom of the lock body 200 and extend up through the neck 235 of the lock body 200, with the flow tracks 230 providing for fluid communication between the exterior and interior of the lock body 200. Flow tracks 230 are oriented parallel to the longitudinal axis of the lock body 200 and are located ninety degrees around the circular exterior of the lock body 200 from the latching finger recesses 220. The extended length of flow track 230 significantly increases the open area for fluid communication, thereby allowing greater unobstructed flow of fluids between the interior and exterior of lock body 200. This results in more consistent, unimpeded flow of downhole fluids through the lock body 200. As an added benefit of this elongated area, debris that may be immersed in the fluid mixture flow will be less likely to become trapped along flow track 230, thereby decreasing the chance for obstructions to develop along the track. In conjunction with a preferred embodiment of neck 235, these features may further improve flow characteristics in the well control tool not available with other tools known in the industry.

In a preferred embodiment, lock body 200 may further comprise a neck 235 with improved flow characteristics over other similar tools in the industry through the extension of the flow tracks 230 into the neck 235. Such improved flow characteristics are achieved through shortening the length of the lock body neck 235, which reduces the relative distance of the lock body 200 that fluids must pass through during production. As a result of lessening the distance traversed through the lock body 200, there is less back pressure on a downhole ESP, which mitigates fluid choke effects, and consequently allows for greater fluid flow through the lock body 200. In the embodiment of the well control tool shown in FIG. 6, the neck 235 is approximately 1.5" in length.

Remaining on FIG. 6, a side view of pin channels 222 with a top portion of inserted latching fingers 300 may be seen. In the relaxed state of the lock body 200, the top end of latching fingers 300 will naturally protrude from the surface of lock body 200 due to the tension provided by latch springs 327 positioned in a spring recess 320.

Next, FIG. 7 provides a cross-sectional view of the lock body 200 of FIG. 6. In FIG. 7, the latch springs 327 are seen located within the spring recess 320 of latching finger 300. The latch springs 327 have an end pressing against the spring recess 320, and a second end pressing against the spring wall 224. In this manner, the top end of latching fingers 300 will protrude from the surface of lock body 200 when the lock body is not engaged with any other parts or components. The bottom of the latching fingers 300 has a detent 315 which engages a detent wall 226 located on the lock body 200 and stops the bottom of the latching finger from further rotation into the lock body 200.

Figure 8:
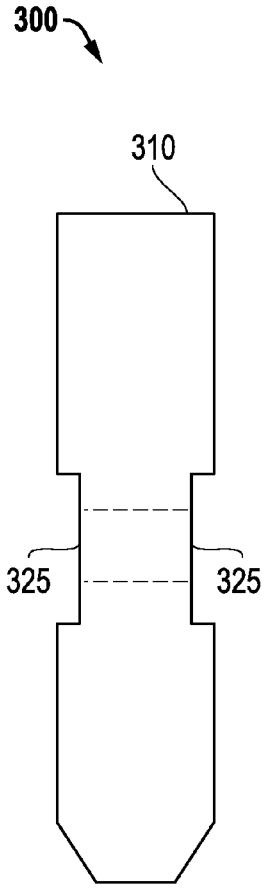
FIG. 8 is a top view of a latching finger of the present invention.
Figure 9:
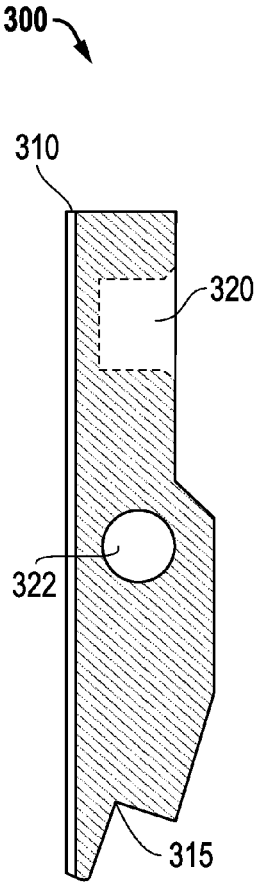
FIG. 9 is a cross-sectional side view of the latching finger of FIG. 8.
Figure 10:
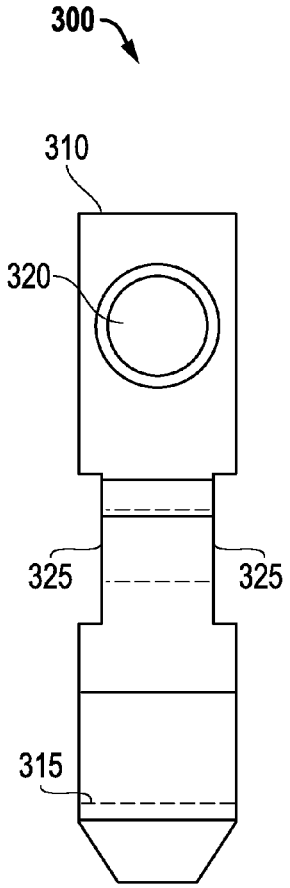
FIG. 10 is a bottom view of the latching finger of FIG. 8.

Referring now to FIGS. 8, 9 and 10, top, side and bottom views of the latching finger 300 are shown. As can be collectively seen in FIGS. 8-10, the latching finger 300 includes a spring recess 320, a pin channel 322 and a latching finger shoulder 310. As described in FIGS. 3-4, a latching finger 300 is placed in each latching finger recess 220 and secured into the recess 220 by means of a latch pin 329 which passes through the pin channels 222 of the lock body 200 and the pin channel 322 of the latching finger 300. Also, as previously described, a latch spring 327 may be placed between the spring wall 224 of the lock body 200 and the latching finger spring recess 320. Under this engagement, the latch spring 327 exerts an outward bias on the end of the latching finger 300 opposite the spring. By means of this arrangement, the latching finger 300 is allowed to rotate about the latch pin 329, which forces the latching finger shoulder 310 outwards from the lock body 200 while forcing the opposite end of latching finger 300 inwards from the exterior of the lock body 200. The opposite end of latching finger 300 further comprises a latching finger detent which engages a detent wall 226 located within latching finger recess 220 of the lock body 200. In this manner, the latching finger 300 may only rotate a certain amount from the outward bias of latch spring 327, thus controlling the distance which the shoulder 310 protrudes from the side of the lock body 200.

In a preferred embodiment of the present invention, latching finger 300 may further comprise a set of notches 325 on either side of the latching finger 300, and adjacent the pin channel 322. Notches 325 are shaped to reduce the opportunity for latching finger 300 to become jammed while rotating about the pin. Further, notches 325 may also assist in the shearability of the pin of latching finger 300 should lock body 200 and consequently tubular seal stem 400 become stuck downhole.

Figure 11:
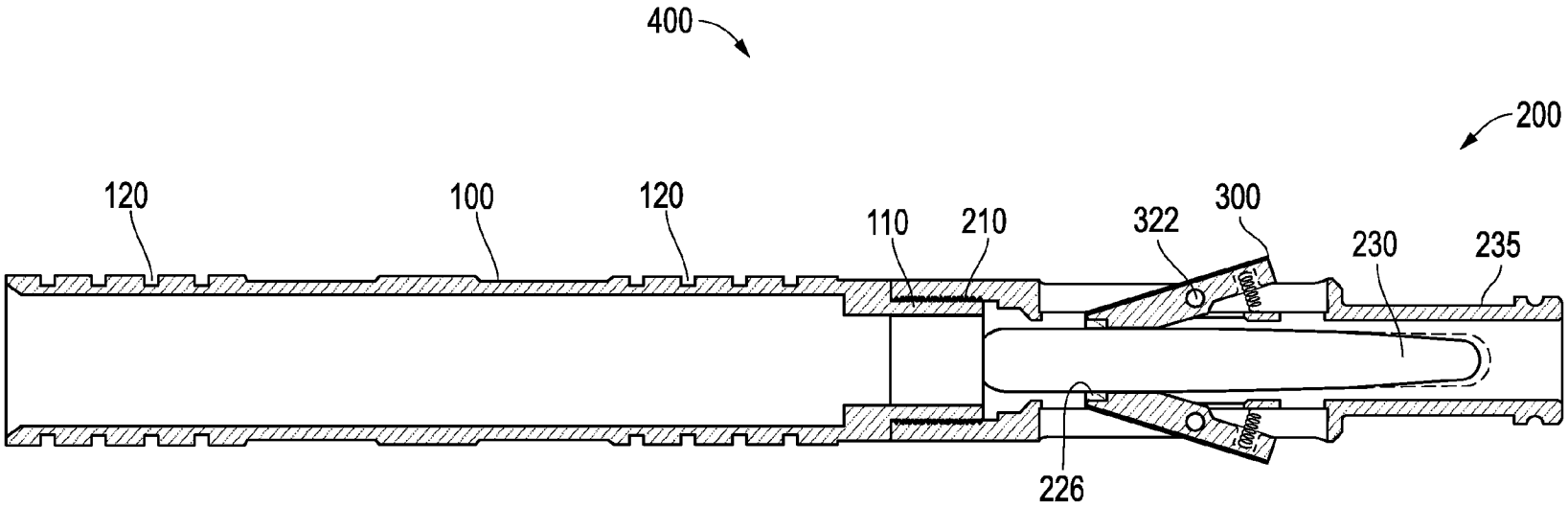
FIG. 11 is a cross-sectional side view of a fully-assembled seal stem of the present invention.

Turning now to FIG. 11, a cross-sectional view of a fully-assembled tubular seal stem 400 is shown. Tubular seal stem 400 comprises the flow nipple 100 and the lock body 200 threadedly connected together via the respective male threaded connector 110 and female threaded connector 210. As previously mentioned, sealing gaskets and/or o-rings may be placed in the lateral channels 120 of flow nipple 100 in order to facilitate a fluid tight seal when the tubular seal stem 400 is placed in a tubular sub-assembly 500. The complete tubular seal stem 400 is then ready for use within the tubular sub-assembly 500 in order to control the flow of fluids through the tubular sub-assembly 500.

Figure 12:
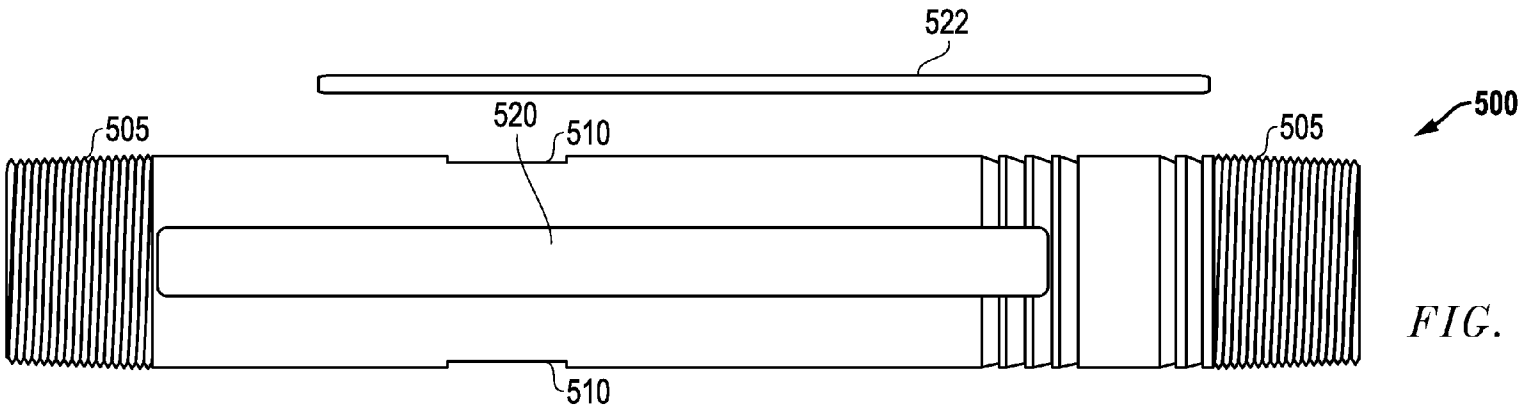
FIG. 12 is a side view of a tubular sub-assembly of the present invention.

Next, FIG. 12 shows a side view of a tubular sub-assembly 500 of a preferred embodiment of the present invention within which the tubular seal stem 400 may be placed when the well control tool is in operation. Sub-assembly 500 has a generally tubular structure and has an internal cavity with a length and width sufficient for engaging and securing seal stem 400. The ends of tubular sub-assembly 500 each have a threaded connector 505 for threaded connection to upstream and downhole portions of a drill string. Along the outer surfaces of the tubular sub-assembly 500 are two longitudinal grooves 520, which are located on opposite sides of the tubular sub-assembly 500 and recessed from the side surface of the tubular sub-assembly 500 and provide an area for locating a cable 522 for the downhole ESP. Cable 522 may be any manner of cable used by a downhole section of the drill string and may comprise electric, hydraulic and other types of lines or cables.

By locating grooves 520 on opposite sides of sub-assembly 500, a well operator may select the appropriate track for optimal routing of cable 522 depending on the location of the cable relative to the position of the groove 520. Further, the benefit of locating cable 522 within groove 520 may help to ensure that cable 522 remains in position along the side of the sub-assembly 500, and does not obstruct ports 510, thereby allowing the well control tool to provide unimpeded flow of fluids downhole. Thus, the grooves 520 provide protection for cable 522 by safely locating the cable 522 away from any potential damage due to particles and debris in the fluid flow.

Figure 13:
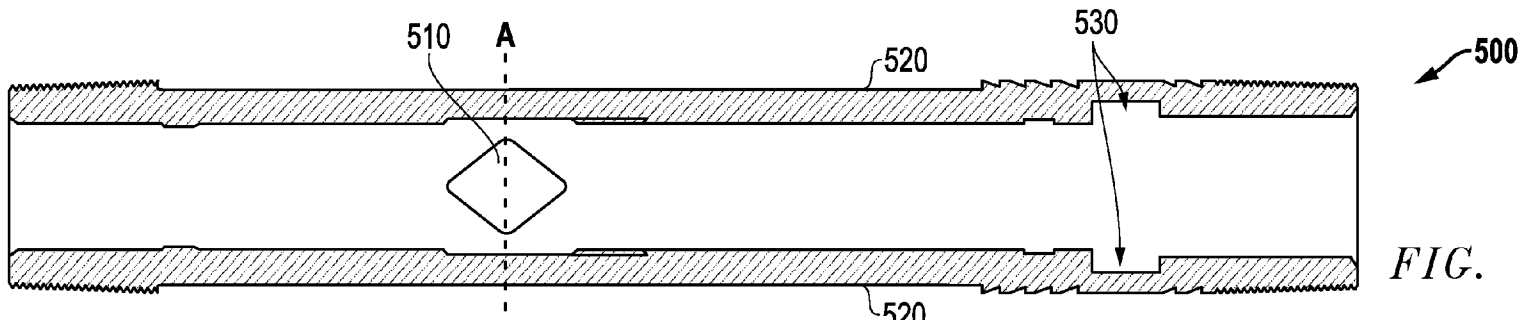
FIG. 13 is a cross-sectional side view of the tubular sub-assembly of FIG. 12 rotated 90 degrees about its longitudinal axis.

Next, at FIG. 13, a cross-sectional view of tubular sub-assembly 500 is shown with the sub-assembly 500 rotated 90 degrees about its longitudinal axis. In the view provided by FIG. 15, a port 510 can be seen located in the side wall of the sub-assembly 500. Port 510 is positioned 90 degrees from the grooves 520 about the longitudinal axis of the sub-assembly 500 and provides fluid communication between the interior and exterior of the sub-assembly 500. An identical port 510 (not shown) is located 180 degrees opposite of the port 510. Thus, the two ports 510 are formed to provide substantially improved flow characteristics of well fluid by allowing for the passage of large pieces of debris typically dispersed within downhole fluids such as kill mud, water, oil or gas.

Figure 14:
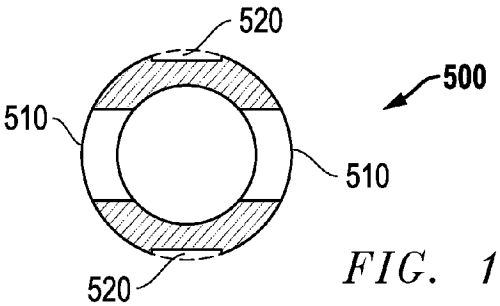
FIG. 14 is a cross-sectional view of the sub-assembly of FIG. 12 as taken along line A.

At FIG. 14, a top cross-sectional view of tubular sub-assembly 500 taken along dotted line A is shown. In this figure, the particular layout of the grooves 520 and ports 510 can be more readily seen. In particular, it can be seen that the ports 510 are oriented opposite one another, and the grooves 520 are oriented opposite one another, with each port 510 located approximately 90 degrees along the longitudinal axis of the sub-assembly 500 from an adjacent groove 520. The particular design of sub-assembly 500 allows for maximum fluid flow through the use of two oppositely aligned ports 510 while also minimizing the opportunity for a cable 522 to obstruct the ports 510 by locating the cable 522 within the grooves 520 as far away from the ports 510 as possible.

In a preferred embodiment of the present invention, ports 510 may be substantially diamond in shape and enlarged to a size that maximizes fluid flow while simultaneously minimizing the opportunity for debris to obstruct the ports. Ports 510 may also be shaped and sized such that the structural integrity of lock flow sub-assembly 500 is not compromised by an overly enlarged port. During the fluid production process, many different types of debris may develop and comingle with fluids to be produced. This debris may include undesirable hydrocarbons such as paraffin, or other compounds such as iron sulfide. As the production fluid is pumped up through the tubular sub-assembly 500 by the ESP, the unwanted paraffin and iron sulfide may begin to build up along the flow track of the sub-assembly 500. If the ports 510 on sub-assembly 500 are improperly shaped or sized, there is a chance that the debris will block the port, thereby causing a halt in fluid production as well as potentially dangerous back pressure further downhole. Additionally, incorrect shaping and sizing of ports 510 may place significant strain on the structural integrity of tubular sub-assembly 500, thereby leading to premature failure of the sub-assembly 500.

However, due to the shape and size of this preferred embodiment for the ports 510, substantially improved fluid flow characteristics may be achieved. As a result of these substantially improved flow characteristics, there is less back pressure on the ESP, and less downtime attributable to having to retrieve and service the tool as a result of blockage. The reduced back pressure also significantly reduces the opportunity for failures to develop in other equipment further downhole, as well as prolonging the useful service life of the well control tool and downhole ESP.

Figure 15:
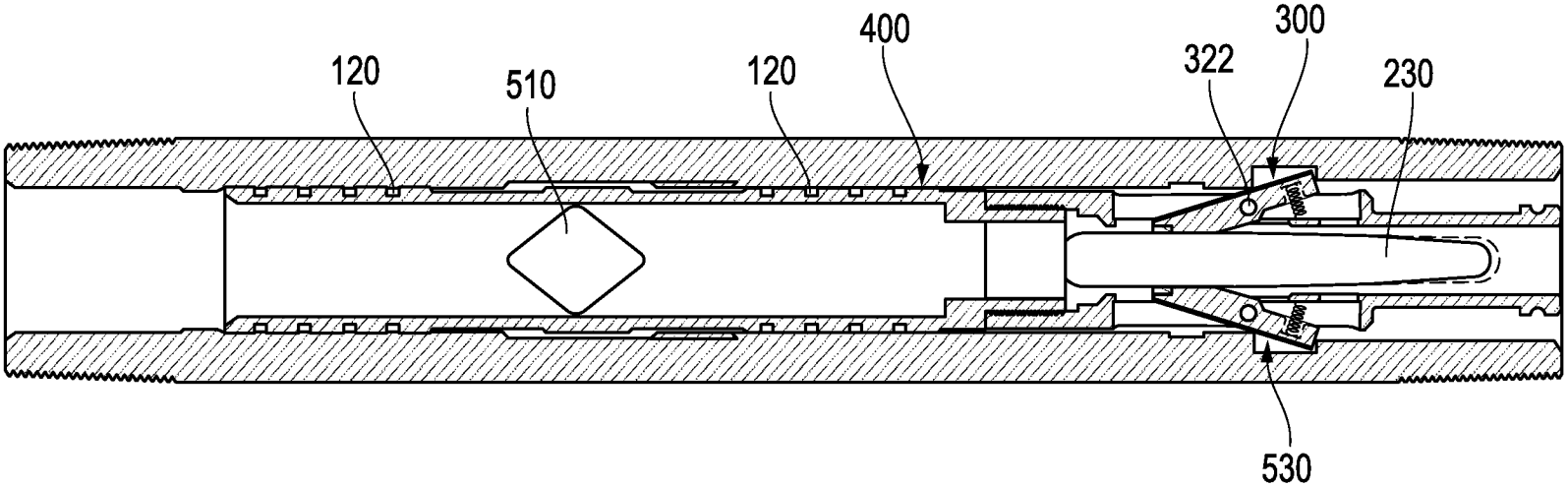
FIG. 15 is a cross-sectional side view of a seal stem inserted into the tubular sub-assembly of FIG. 12.

Referring to FIG. 15, therein is shown a cross-sectional view of the seal stem 400 located within the tubular sub-assembly 500. Through the use of a setting tool, the tubular seal stem 400 may be set into the tubular cavity provided by the tubular-sub assembly 500 by way of the top hole of the tubular sub-assembly 500 in order to seal the flow of fluids through the ports 510 of the tubular sub-assembly 500. Prior to setting the tubular seal stem 400 into the tubular sub-assembly 500, commonly used seals in the field, such as gasket seals or o-rings, may be fitted onto the flow nipple 100 by engaging the gasket seals or o-rings into the circumferential lateral channels 120 located on the exterior of the flow nipple 100. Upon insertion of the tubular seal stem 400 into the tubular sub-assembly 500, a fluid tight seal may be formed as a result of the gasket seals or o-rings engaging both the exterior wall of the flow nipple 100 and the interior wall of the sub-assembly 500. These seals ensure that no fluid may flow through the ports 510 of the tubular sub-assembly 500. Once the tubular seal stem 400 has been set into the tubular sub-assembly 500, the setting tool may be pulled in an upward motion to ensure that the tubular seal stem 400 is locked in place.

The interior of the tubular sub-assembly 500 has a circumferential recessed area near a top end of the sub-assembly 500 and adjacent the lock body 200, forming lateral circumferential recessed shoulders 530 along the interior of the sub-assembly 500. When the tubular seal stem 400 is placed within the tubular sub-assembly 500 using a downward motion, the latching finger shoulders 310 will be forcibly depressed back into the latching finger recesses 220 of the lock body 200. However, once the shoulders 310 are slidingly engaged with the recessed shoulders 530, the latching finger shoulders 310 spring back out and lock with the recessed shoulders 530, thereby preventing upward movement and withdrawal of the seal stem 400, thus locking the seal stem 400 in place. Additionally, the seal stem 400 is prevented from further downward movement in this position as a result of the engagement of the bottom end of the seal stem 400 with the interior wall of the sub-assembly 500.

Accordingly, while seal stem 400 is engaged within tubular sub-assembly 500, fluids may only flow through the top or bottom apertures of the sub-assembly 500, as the ports 510 are effectively shut off from fluid flow. In this manner, the well control tool controls the flow of downhole fluids such that an operator at the surface may determine whether the flow of fluid through the ports 510 is desired in a given scenario.

Figure 16:
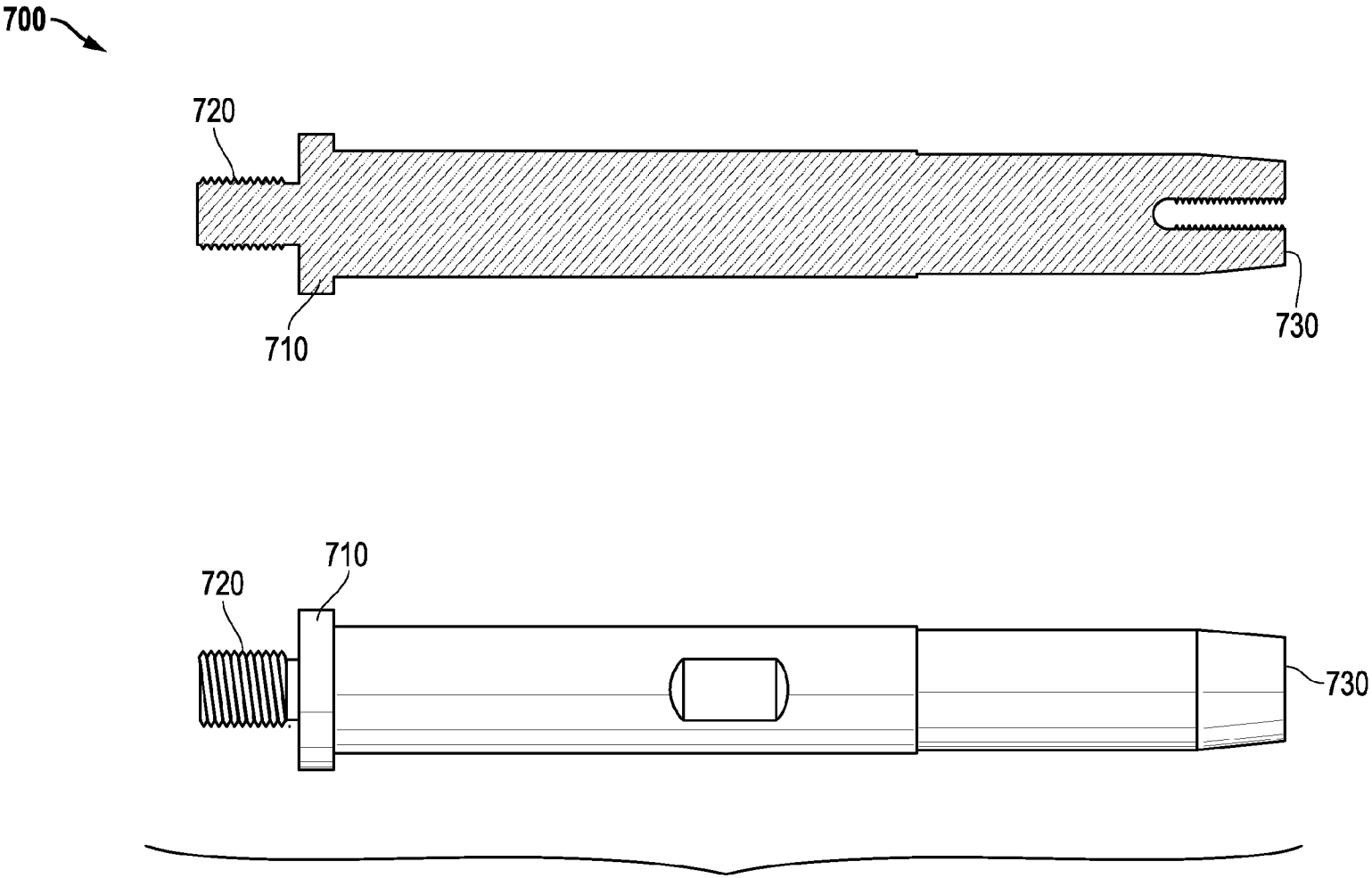
FIG. 16 depicts a side view and a cross-sectional side view of a releasing probe for the present invention.

Next, in FIG. 16, side and cross-sectional views of a releasing probe 700 are provided which is essentially a solid cylindrical shape and includes a shoulder 710. Using a standard overshot tool (not shown), a threaded end 720 of the releasing probe 700 may be attached to the overshot tool in order to engage and release the tubular seal stem 400 from the tubular sub-assembly 500, or more specifically, to disengage the latching fingers 300 located on the lock body 200 from the recessed shoulders 530 of the sub-assembly 500. By inserting a downhole end 730 of the releasing probe 700 through the interior of the tubular seal stem 400, the probe 700 will engage and actuate the latching fingers 300, rotating them until the shoulder 710 passes the latching fingers shoulder 310, at which point the springs cause the latching fingers 300 to rotate back into their unbiased position. In this orientation, the latching fingers shoulders 310 prevent the releasing probe 700 from being withdrawn from the tubular seal stem unless the seal stem is manipulated as described above to allow the tubular seal stem 400 to be disengaged from the tubular sub-assembly 500. Once the latching fingers 300 have been disengaged, an upward motion on the releasing probe 700 releases the tubular seal stem 400 to be retrieved at the surface. If for some reason the latching fingers 300 become stuck such that the releasing probe 700 is unable to actuate the latching fingers 300, the pins 222 may be designed to be shearable so that a mechanical jar will shear pins 222 and disengage latching fingers 300, thereby releasing the tubular seal stem 400.

Figure 17:
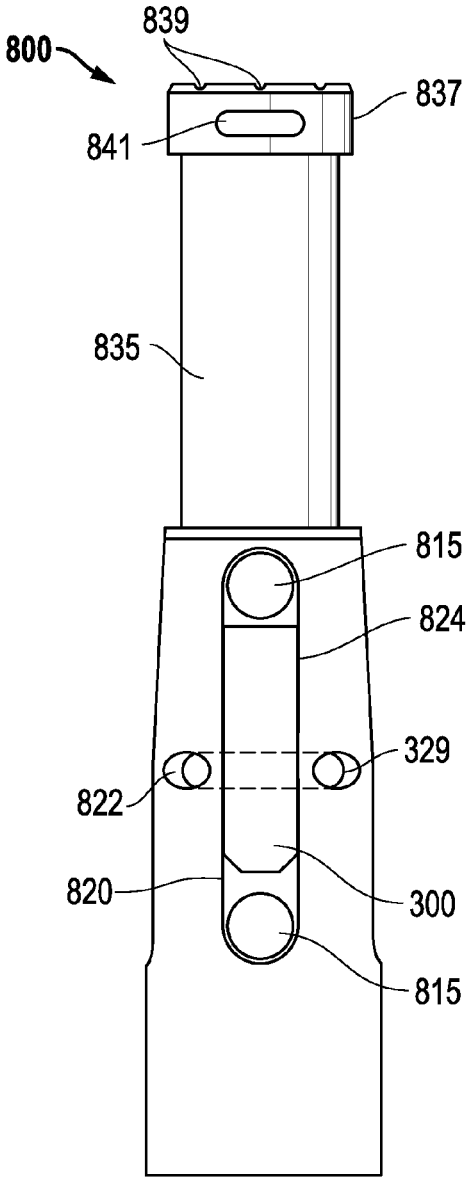
FIG. 17 is a side view of a lock body in accordance with another preferred embodiment of the present invention.

Turning next to FIG. 17, a side view of another preferred embodiment of a lock body 800 is shown. Lock body 800 is a replacement of the lock body 200 and may be threadedly engaged to flow the nipple 100 in similar fashion to the lock body 200. Lock body 800 has corollary parts and functionality with the lock body 200. For instance, lock body 800 has through-holes 815, latching finger recesses 820, pin channels 822, spring walls 824, detent walls 826, flange 837, plunges 839, and pinning mounts 841 which are substantially similar to the corresponding parts in lock body 200. However, in lock body 800, the neck 835 has been lengthened to approximately 2.0" as compared to the approximately 1.5" length of the neck 235 for lock body 200. The advantage of the lengthened neck 835 as compared to the neck 235 is to provide a greater extension of the lock body 800 in order for easier latching and retrieval of the lock body 800. In particular, for situations where there may be a buildup of downhole debris around the lock body 800, such as buildup of iron sulfide or paraffin mixtures, the additional extension provided by the elongated neck 835 may allow for the top flange 837 of the lock body 800 to protrude sufficiently for retrieval of the tool. Additionally, the latching finger 300 shown in this embodiment removes the use of notches 325.

Figure 18:
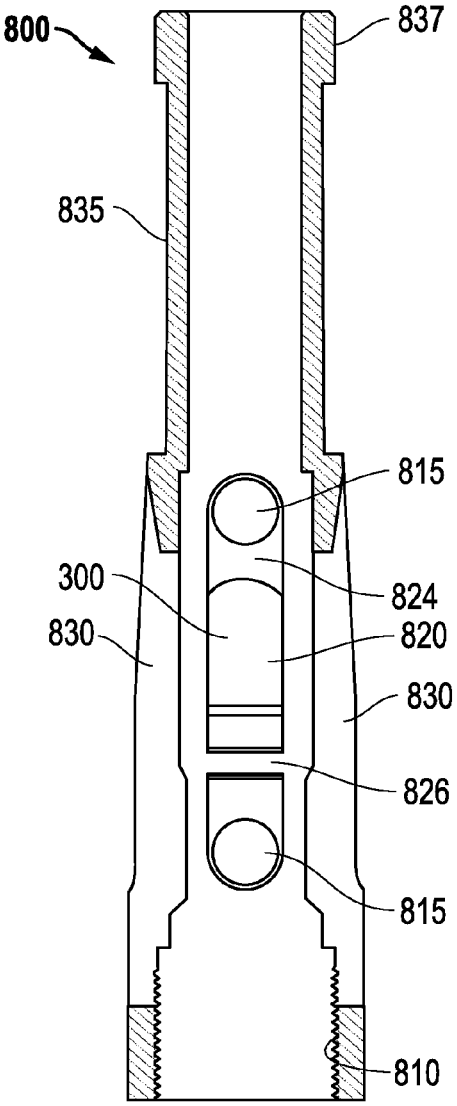
FIG. 18 is a cross-sectional view of the lock body of FIG. 17.

At FIG. 18, a cross-sectional view of the lock body 800 of FIG. 17 is shown. Here, another difference between the lock body 200 and lock body 800 can be seen in that the flow tracks 830 no longer extend into the neck 835 as with flow tracks 230 of lock body 200. Rather, flow tracks 830 terminate at a lateral distance adjacent the spring wall 824. Thus, flow tracks 830 are shorter and provide less flow area relative to flow tracks 230 of the lock body 200. However, as a tradeoff for the lesser flow rate provided by lock body 800, the neck 835 provides increased structural integrity and durability of the lock body 800 as compared to lock body 200. Thus, for certain applications where the priority is placed in maximizing fluid flow, the lock body 200 may be used to provide the greatest amount of flow area. In instances where the downhole fluids may cause problems as a result of buildup of debris, such as iron sulfide or paraffin, the lock body 800 may alternatively be used to provide greater structural integrity of the lock body as well as ease of tool retrieval.

Figure 19:
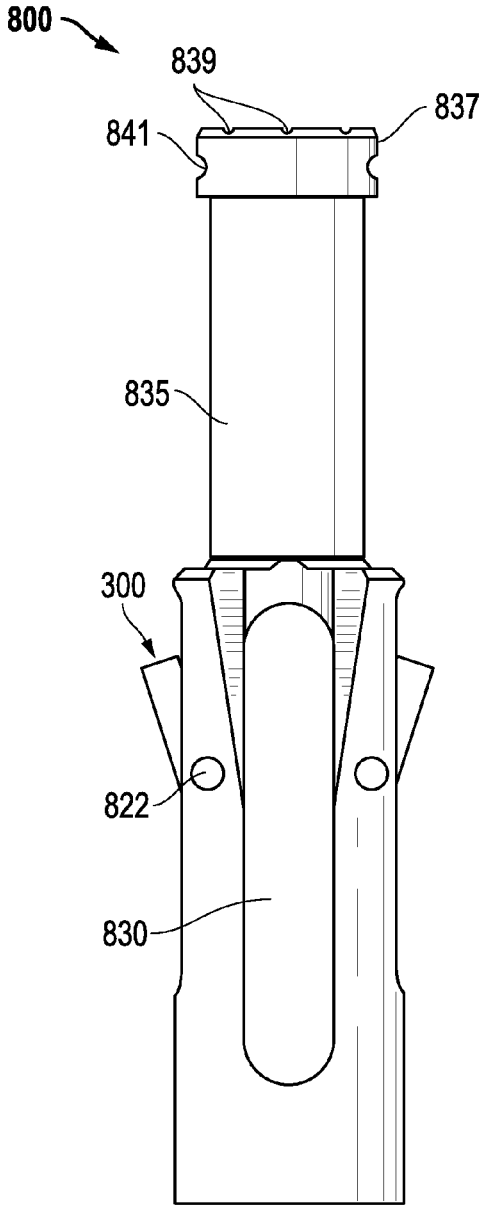
FIG. 19 is a side view of the lock body of FIG. 17 rotated 90 degrees about the longitudinal axis.
Figure 20:
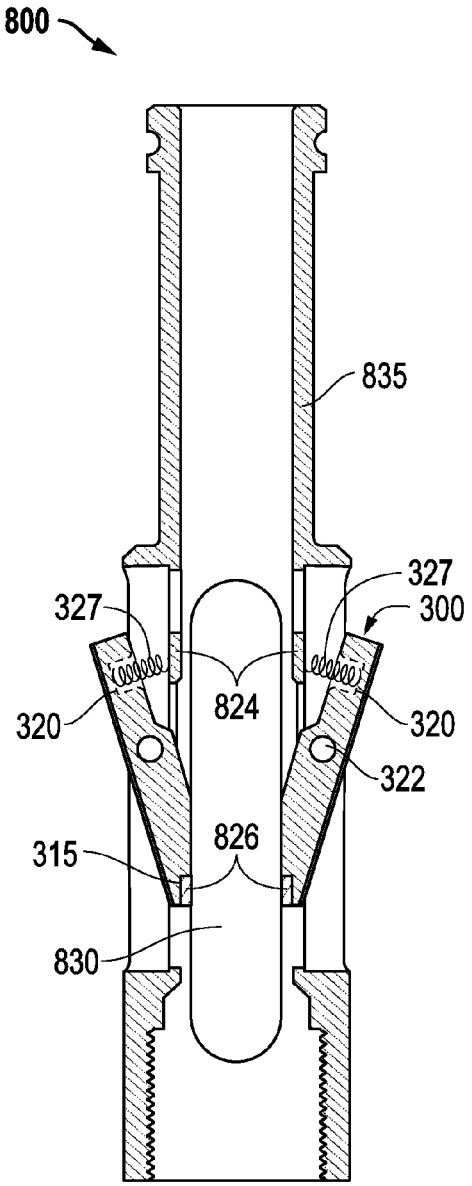
FIG. 20 is a cross-sectional view of the lock body illustrated in FIG. 19.

Next, at FIGS. 19-20, side and cross-sectional views of the lock body 800 are shown rotated approximately 90 degrees about its longitudinal axis from the view of lock body 800 shown in FIGS. 17-18. Here, it can be more clearly seen that flow tracks 830 have been shortened relative to the flow tracks 230 of lock body 800. In particular, the top end of flow track 830 now terminates roughly adjacent the top of latching finger 300, and no longer extends into the neck 835. All other elements of lock body 800 remain essentially the same as with lock body 200, including the spring wall 824 and detent wall 826, for example.

In a preferred embodiment of the present invention, the flow nipple 100, lock body 200 and tubular sub-assembly 500 may be fabricated from stainless steel or other suitably durable and wear-resistant materials. Other materials may also be used to fabricate the components of the well control tool so long as they have sufficient wear, corrosion and hardness to withstand the intense pressures and temperatures as is typical in a downhole environment. Further, the latching fingers 300 and latch pin 329 may also be fabricated from various suitable metals, with the latch pin 329 ideally manufactured to be shearable in the event the lock body 200 becomes stuck within the sub-assembly 500.

Figure 21:
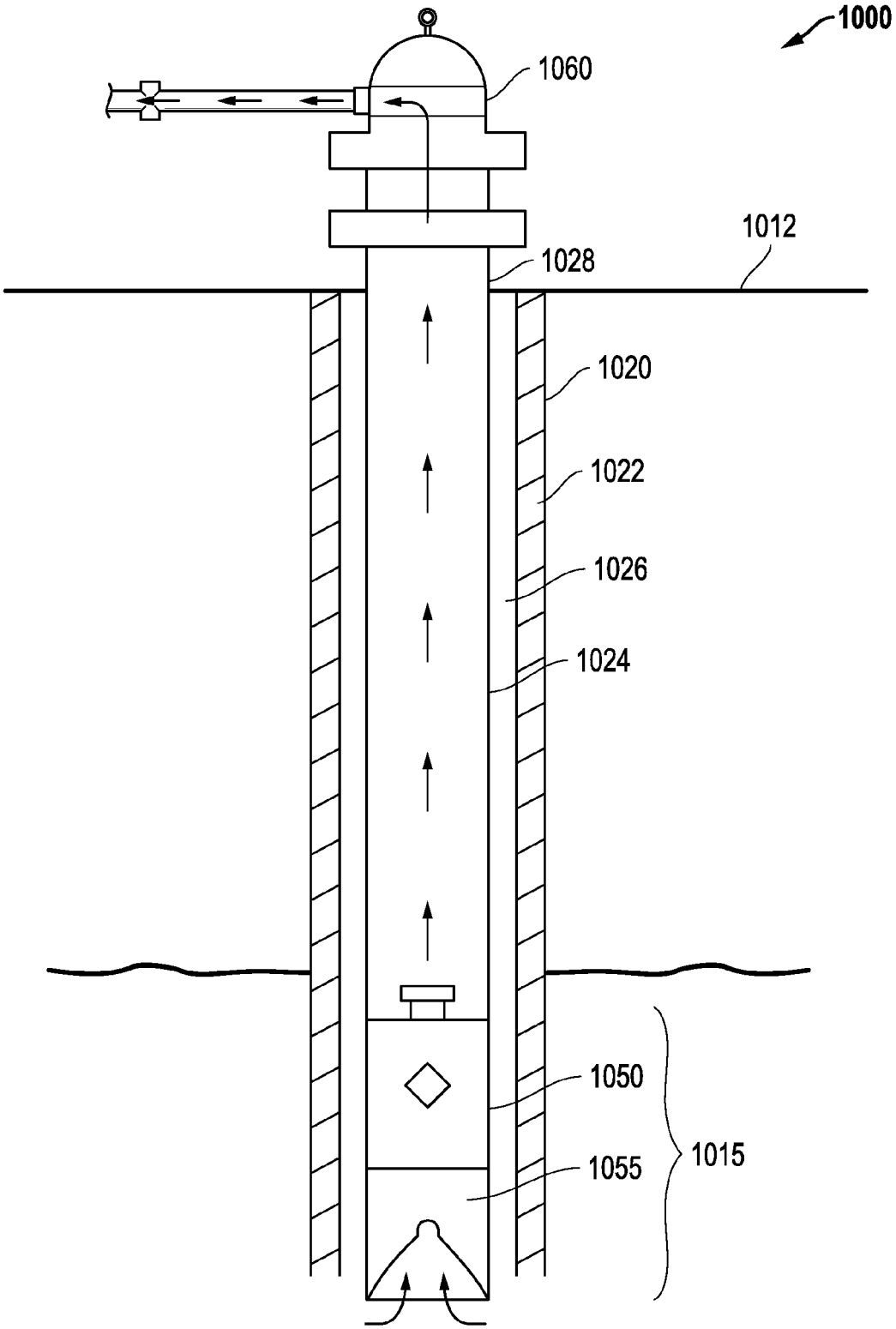
FIG. 21 is a schematic view of an embodiment of the present invention operating in a well illustrating the flow of oil and/or gas to the surface.

Referring to FIG. 21, a production well 1000 is provided. The production well 1000 comprises a wellbore 1020. The wellbore 1020 drilled into the surface 1012 of the Earth and through an oil and/or gas bearing production zone 1015. The sides of the wellbore 1020 are lined with casing 1022. Tubing string 1024 inserted into the wellbore 1020. Annulus 1026 is formed between the tubing string 1024 and the casing 1022 (or the wellbore 1020 if no casing is present). A well control tool 1050 in accordance with an embodiment of the present invention is connected to the lower end of the tubing string 1024. The well control tool 1050 is substantially identical to the well control tools discussed above. Optionally, an electronic submersible pump (ESP) 1055 is connected below the well control tool 1050. A master valve 1060 is connected to the wellhead 1028 and allows for the production of oil and/or gas. Arrows illustrate the flow of oil and/or gas from the production zone 1015 to the ESP 1055, through the well control tool 1050, up the tubing string 1024, and out the master valve 1060. The well control tool 1050 is in the closed position with the seal stem engaged within the tubular sub-assembly (see FIG. 15), thus preventing communication of fluids and/or gas through the port.

Figure 22:
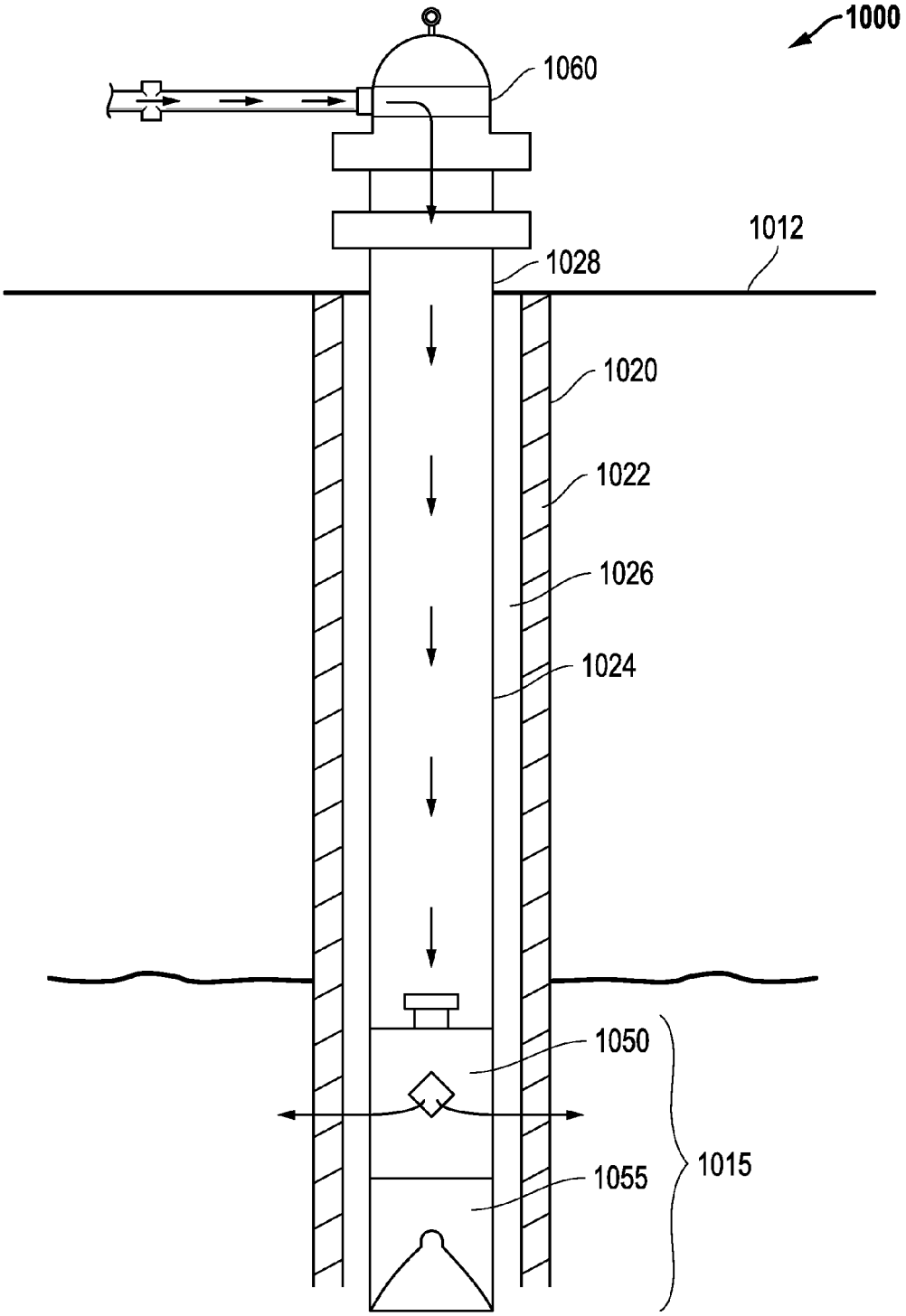
FIG. 22 is a schematic view of an embodiment of the present invention operating in a well illustrating the injection of fluids or gas into the well.

Referring to FIG. 22, the arrows show the direction of drilling fluids being injected into a well 1000. As shown, drilling fluids from the surface flow through the master valve 1060 and into the tubing string 1024. From there, the drilling fluid enters the well control tool 1050. Prior to pumping drilling fluids, the well control tool 1050 is placed into the open position by removing the seal stem from the tubular sub-assembly using wire-line tools. Optionally, a plug may also be inserted downhole of the well control tool 1050 to prevent drilling fluid from entering the ESP 1055 using wire-line tools. Thus, drilling fluid is free to exit through the port of the well control tool 1050 as shown by the arrows. The drilling fluid travels up the annulus 1026, pressure is equalized on the interior and exterior of the tubing string 1024. Alternatively, drilling fluid may be pumped down the annulus and then up the tubing string. The hydrostatic weight of the column of drilling fluid (typically heavy mud) in the wellbore exceeds the pressure of the oil and gas in the formation, thus controlling the well and preventing the well from blowout. This allows the tubing string to be safely pulled to the surface thereby allowing the well and equipment to be serviced. Similarly if the well 1000 was an injection well, fluids or gases may be injected into the well in order to increase recovery at nearby production wells.

Figure 23:
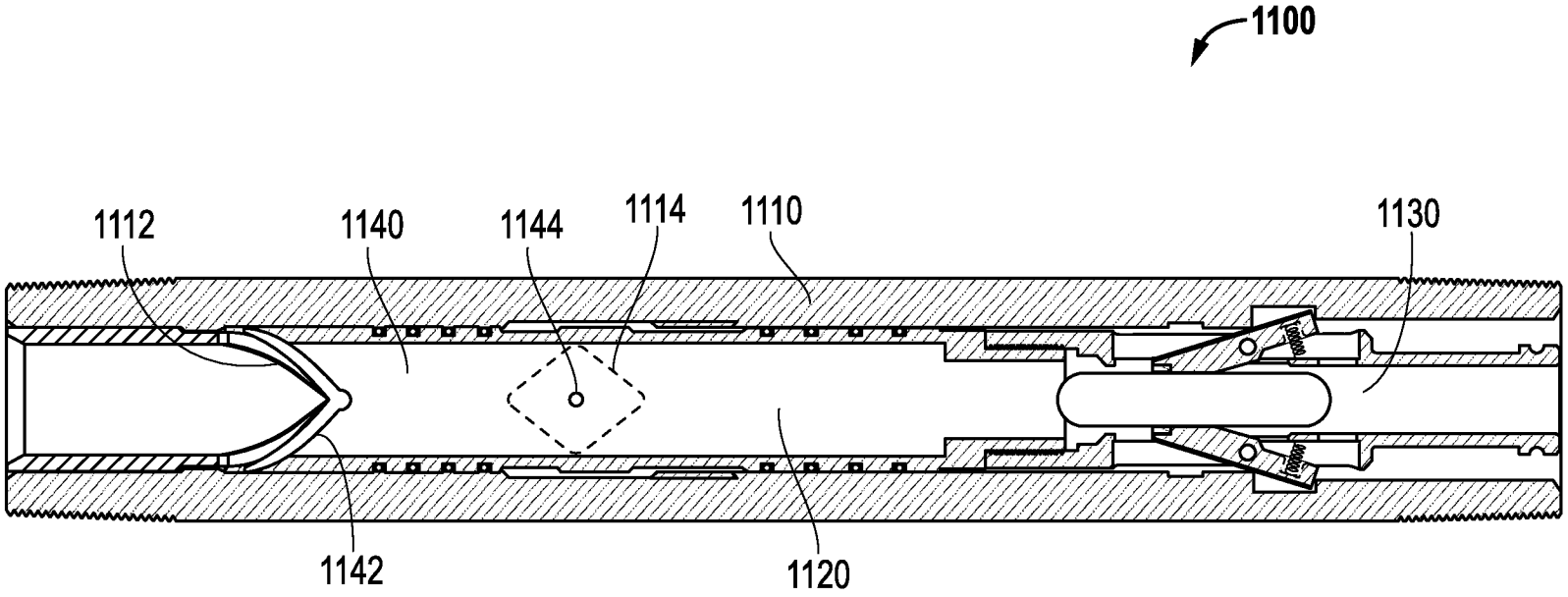
FIG. 23 is a cross-sectional view of an improved well control tool in accordance with the present invention.

Referring to FIG. 23, an improved well control tool 1100 in accordance with the present invention is shown. Well control tool 1100 comprises improved tubular sub-assembly 1110. The improved tubular sub-assembly 1110 is substantially identical to the tubular sub-assembly 500 shown in FIGS. 12-14 except that it further includes an orientation sleeve 1112. Located within the tubular sub-assembly 1110 is a fully-assembled, ported seal stem 1120. The ported seal stem 1120 comprises a lock body 1130 and a ported flow nipple 1140. Lock body 1130 is substantially identical to lock body 200 shown in FIGS. 6-7 and described above. In alternative embodiments, lock body 1130 may be substantially identical to lock body 800 shown in FIGS. 17-20 and described above. Ported flow nipple 1140 has a pair of orientation grooves 1142 and a pair of orifices 1144, one on each side. When the ported seal stem 1120 is inserted into the tubular sub-assembly 1110, the orientation sleeve 1112 causes the ported seal stem 1120 to rotate such that its orientation grooves 1142 line up with the orientation sleeve 1112 of the tubular subassembly 1110. When the orientation sleeve 1112 and the orientation grooves 1142 are in alignment, each orifice 1144 is also in alignment with its respective port 1114 on the tubular subassembly 1110. Thus, proper alignment of the orifices 1144 with the ports 1114 is ensured when the ported seal stem 1120 is inserted into the improved tubular subassembly 1110.

Figure 24:
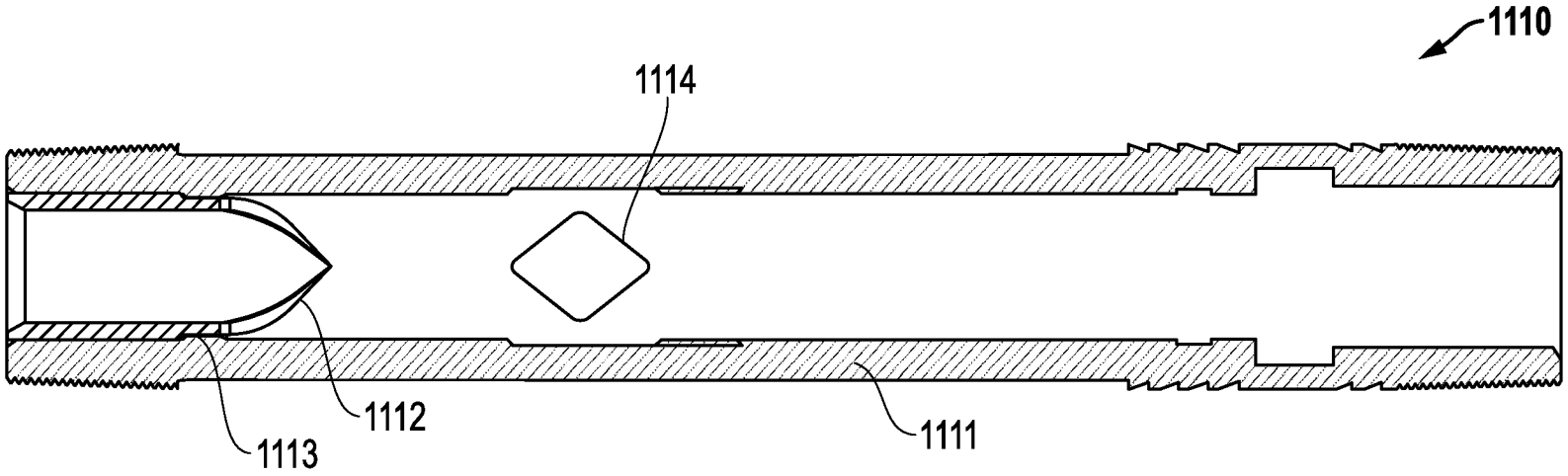
FIG. 24 is a side view of an improved tubular sub-assembly shown in FIG. 23.
Figure 25:
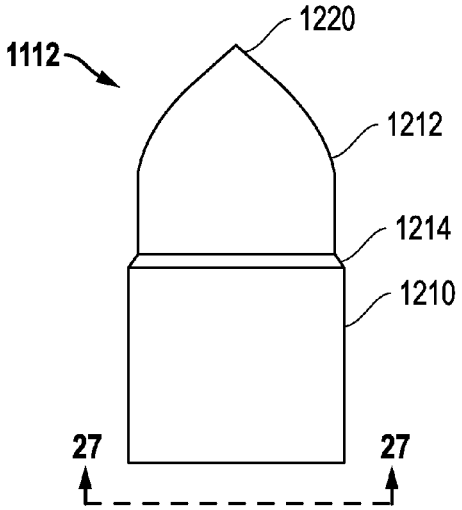
FIG. 25 is a side view of an orientation sleeve of the improved tubular sub-assembly shown in FIG. 24.
Figure 26:
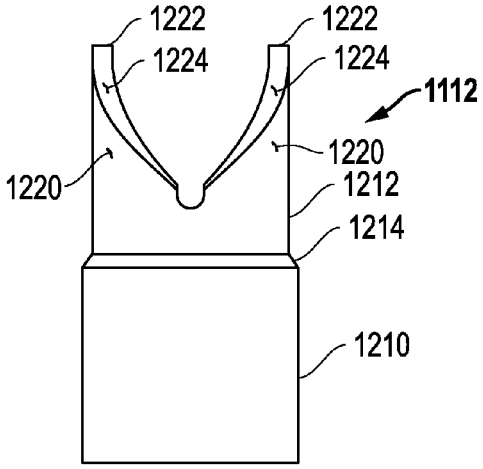
FIG. 26 is a side view of the orientation sleeve shown in FIG. 25 rotated 90 degrees.
Figure 27:
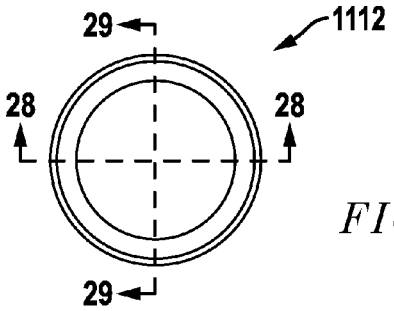
FIG. 27 is a bottom view of the orientation sleeve taken along line 27.
Figure 28:
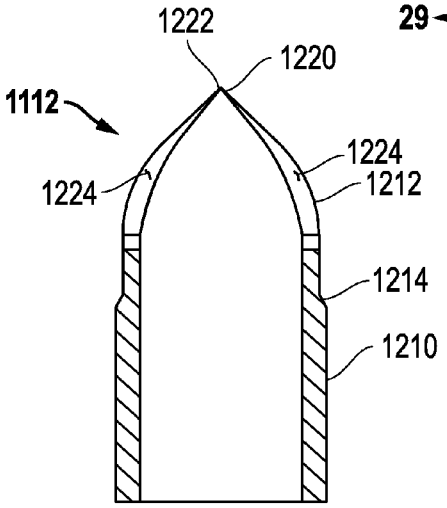
FIG. 28 is a cross-sectional view of the improved tubular sub-assembly taken along line 28.
Figure 29:
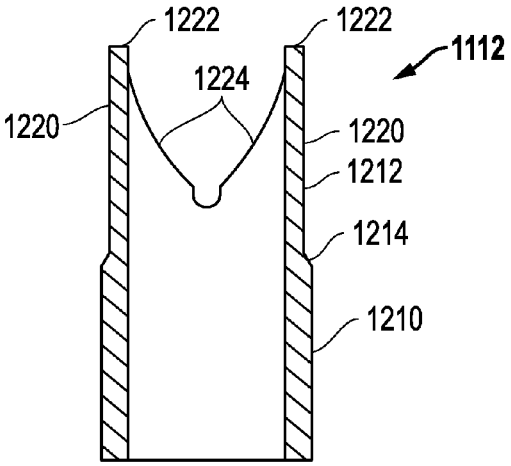
FIG. 29 is a bottom view of the improved tubular sub-assembly taken along line 29.

Referring to FIG. 24, the improved tubular sub-assembly 1110 including orientation sleeve 1112 is further illustrated. Improved tubular sub-assembly 1110 comprises a tubular body 1111 and an orientation sleeve 1112. Tubular body 1111 is substantially identical to tubular sub-assembly 500 as shown in FIGS. 12-14 and described above. Preferably, the orientation sleeve 1112 is manufactured separately and welded to tubular body 1111.

Referring to FIGS. 24-29, the orientation sleeve 1112 is generally cylindrical with a hollow interior. The orientation sleeve 1112 has lower body 1210 and an upper body 1212. The lower body 1210 has a larger outside diameter than that of the upper body 1212. The lower body 1210 is connected to the upper body 1212 by a chamfered portion 1214. The outside diameter of the lower body 1210 is slightly less than the inside diameter of the body 1111, but greater than the inside diameter of no-go 1113. While, the outside diameter of the upper body 1212 is less than the inner diameter of no-go 1113. Thus, when the orientation sleeve 1112 is inserted into the bottom end of the body 1111 the chamfered portion 1214 urges against the bottom portion of no-go 1113. Thus, proper vertical placement of the orientation sleeve 1112 in body 1111 is ensured. A pair of guide rails 1220 are formed in the upper portion 1212. In alternative embodiments, a single guide rail may be used. Each guide rail 1220 has a peak 1222 and a pair of guide slopes 1224 that slope away from the peak.

Figure 30:
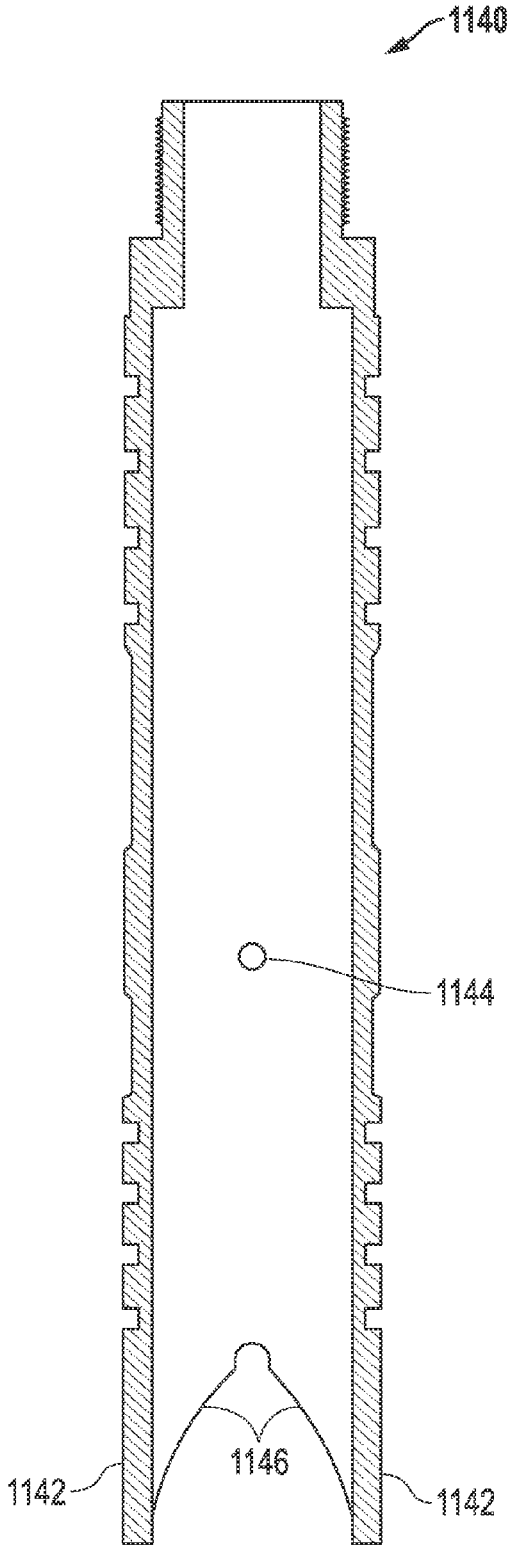
FIG. 30 is a cross-sectional view of a ported flow nipple shown in FIG. 23.

Referring to FIG. 30, ported flow nipple 1140 has a pair of orientation grooves 1142. The orientation grooves 1142 has a pair of guide slopes 1146 that are complementary to the guide slopes 1224 on the guide rails 1220 of the orientation sleeve 1112 (see FIG. 24). In alternative embodiments with a single guide rail, a single orientation groove is used. The ported flow nipple 1140 has the same inside and outside diameter as that of the upper portion 1212 of the orientation sleeve. The ported flow nipple 1140 has a pair of orifices 1144. Each orifice 1144 corresponds to the location of each port in the tubular sub-assembly 1110 when the ported flow nipple is properly seated as the orientation sleeve 1112 is mounted to the body 1111 so as to achieve such an alignment (see FIG. 23). The exact size and shape of the orifice is determined by the desired flow characteristics. In all other respects, the ported flow nipple is substantially identical to the flow nipple 100 described above.

Figure 31:
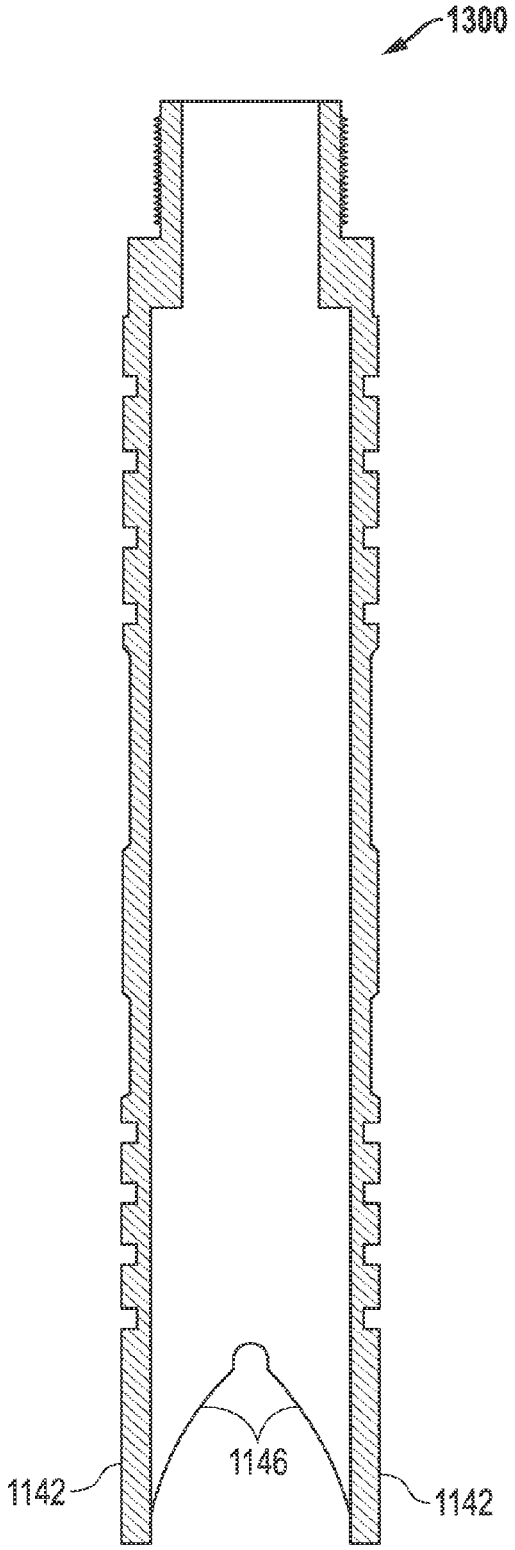
FIG. 31 is a cross-sectional view of a flow nipple for use with the improved well control tool shown in FIG. 23.

Referring to FIG. 31, another embodiment of a flow nipple 1300 is provided. Flow nipple 1300 is substantially identical to ported flow nipple 1140, except that it does not have any orifice. Flow nipple 1300 can be used to shut off a production zone as explained in more detail below.

Figure 32:
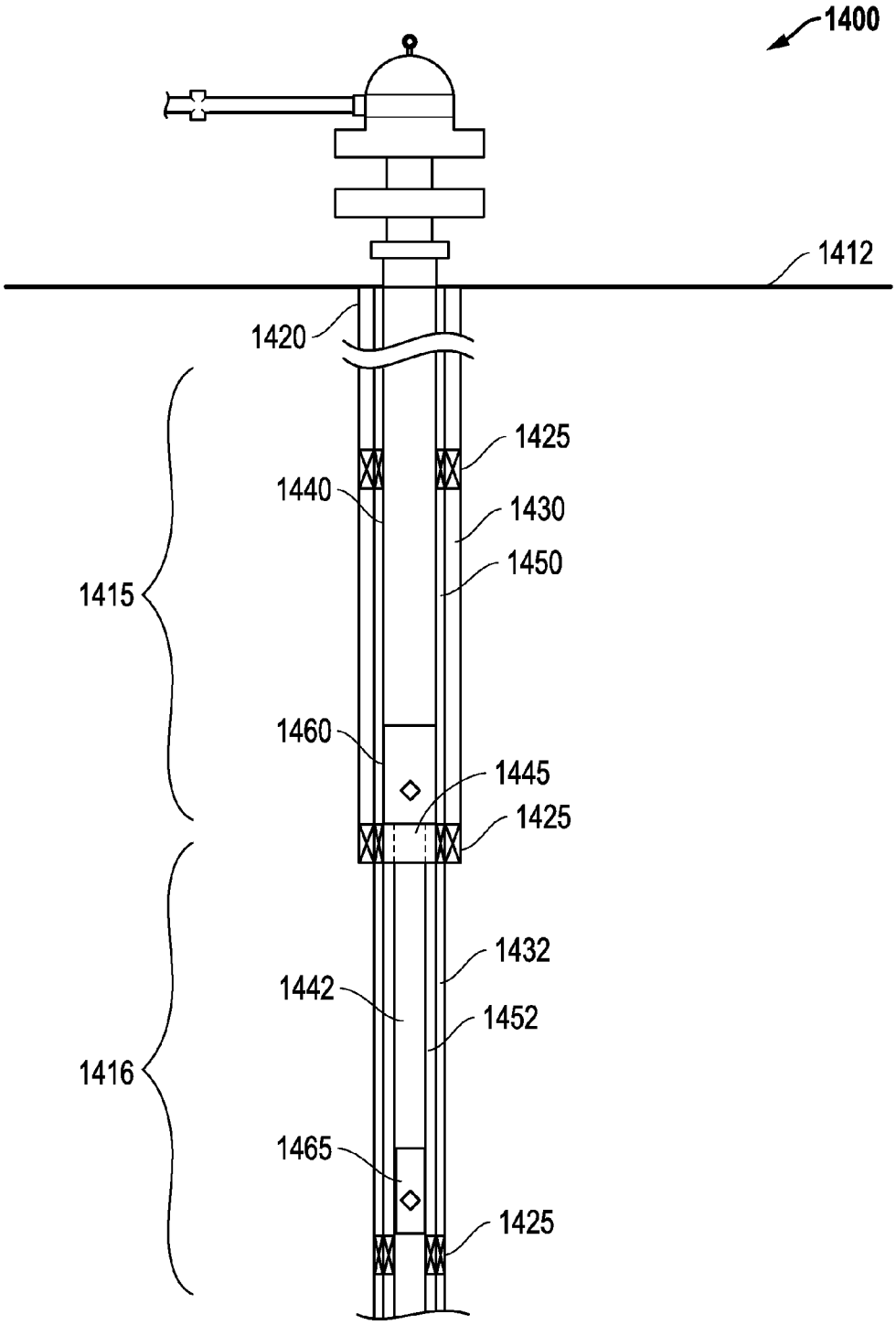
FIG. 32 is a schematic view of the improved well control tool shown in FIG. 23 operating in a multi-production-zone well.

Referring to FIG. 32, improved well control tools 1460 and 1465 are exemplified in a multi-production-zone well 1400. The well 1400 comprises a wellbore 1420 that is drilled into the surface 1412 of the Earth. As is typical, wellbore 1420 has a smaller diameter as it gets deeper. The well 1400 has two production zones shown: Production Zone A 1415 and Production Zone B 1416. The improved well control tool of the present invention is contemplated for use in wells having more than two production zones or a single production zone. The production zones are separated by packers 1425. The sides of the wellbore 1420 in Production Zone A are lined with casing 1430, while the sides of the wellbore 1420 in Production Zone B are lined with casing 1432 having a smaller diameter than that of casing 1430. Similarly tubing string 1440 in Production Zone A has a larger diameter than tubing string 1442 in Production Zone B and are connected by a profile nipple 1445. Annulus 1450 is formed between the tubing string 1440 and the casing 1430 (or the wellbore if no casing is present) in Production Zone A. And, annulus 1452 is formed between the tubing string 1442 and the casing 1432 (or the wellbore if no casing is present) in Production Zone B. A master valve 1455 is connected to the head of wellbore 1420 and allows for the collection of oil and/or gas being produced or the injection of fluids into the well. A first improved well control tool 1460 is connected to the bottom of the tubing string 1440 in Production Zone A. The first improved well control tool 1460 is substantially identical to the improved well control tool 1100 discussed above. More particularly, the improved tubular sub-assembly (see element 1110) of the improved well control tool 1460 is screwed into the tubing string. A second improved well control tool 1465 is connected to the bottom of the tubing string 1442 in Production Zone B. The second improved well control tool 1465 is substantially identical to the first well control tool 1460 except that the second improved well control tool 1465 is of a smaller diameter. Optionally, an electronic submersible pump (ESP) may be connected below either or both well control tools.

Using the well control tools 1460 and 1465 an operator may precisely control production oil and/or gas in both zones. For example, if the operator desired to produce oil or gas from only Production Zone B, the operator would close the port of well control tool 1460 and open the port of the well control tool 1465. It is assumed that both well control tools are in the open position with no seal stem located in their tubular sub-assemblies to begin. Then the operator selects the appropriate ported flow nipple having an orifice size corresponding to the flow characteristics desired. The operator screws the ported flow nipple into a lock body, thus assembling a ported seal stem. Then, the operator lowers the ported seal stem into the tubular sub-assembly of the second well control tool 1465 using wire-line tools. When the orientation grooves of the ported flow nipple contacted the guide slopes of the orientation sleeve, the ported seal stem would rotate thereby allowing the ported seal stem to become fully seated (see FIG. 23). Only when fully seated do the latching fingers of the lock body engage. An operator may positively confirm proper seating by attempting raise the seal stem using the wireline tool. The seal stem can be passed through the larger inside diameter of first well control tool 1460 because the seal stem has a smaller outside diameter than the smallest inside diameter of the first well control tool. Alternatively if no choking was desired, the operator could remove any seal stem from the well control tool 1465, thus allowing unimpeded communication between annulus 1452 and the tubing string 1442. This would also be useful in injection operations or when killing the well. Next, the operator would seal off Production Zone A. Again, using wire-line tools, the operator lowers a seal stem having non-ported flow nipple (e.g., 1300) into the tubular sub-assembly of the first well control tool 1460. This would close communication between the annulus 1450 and the tubing string 1440 in Production Zone A but still allow the flow of oil and/or gas through the tubing string from Production Zone B up to the surface.

Alternatively, if the operator desired to produce only from Production Zone A, that could easily be done with the present invention. A releasing probe (see FIG. 16) is attached to the end of the wireline tool and lowered down the tubing string. It enters the hollow interior of the lock body of the non-ported seal stem and urges against the latching finger thus disengaging them from the tubular sub-assembly of the first well control tool 1460. Then, the seal stem may be pulled to the surface. If the seal stem were frozen or jammed in place, the latching fingers could be shears sheared off and the seal stem could then be pulled to the surface. The operator has positive confirmation that the first well control tool is in the open position once the seal stem is at the surface. Next, the operator would insert a blanking plug into the profile nipple using wire-line tools thereby preventing the flow of fluid and/or gas from Production Zone B into Production Zone A. If choking was desired, the appropriate ported flow nipple would be selected and fitted onto a lock body, and then the ported seal stem would be lowered into the tubular sub-assembly of the first well control tool 1460. This seal stem would be of a large diameter, thus would be unable to pass through the tubular sub-assembly of the first well control tool 1460. As discussed above, the ported seal stem would automatically align when inserted. Thus, production may begin for Production Zone A.

It will be understood that while specific embodiments of the instant invention have been described, other variants are possible and are encompassed within this description, which will be readily apparent to those of ordinary skill in the art and will be readily understood to be encompassed by the instant invention. Those of ordinary skill in the art will understand the methods of fabricating the instant invention and will readily comprehend its manner of use and intended use.

The invention claimed is:

1. An apparatus for controlling the flow of oil and/or gas in a production well, the apparatus comprising:

a tubular body having an interior cavity, the tubular body adapted for connection into a production tubing string and the tubular body having one or more circumferential ports adapted to permit fluid communication between the interior cavity and the exterior of the tubular body; and, an orientation sleeve coupled to the tubular body, the orientation comprising one or more guide slopes, wherein the one or more guide slopes are adapted to rotationally align a seal stem having complementary guide slopes when a seal stem having complementary guide slopes is seated in the tubular body.

2. The apparatus of claim 1 further comprising a threaded connector on a first end of the tubular body adapted for connecting the apparatus to an end of a tubing string.

3. The apparatus of claim 1 wherein at least one of the one or more ports being of a substantially diamond shape.

4. The apparatus of claim 1 wherein the tubular body further comprises at least one longitudinal groove on an exterior surface thereof.

5. The apparatus of claim 4 wherein the longitudinal groove is adapted for locating a cable.

6. The apparatus of claim 1 wherein the tubular body further comprises one or more lateral circumferential grooves located along the exterior of the tubular body.

7. The apparatus of claim 1 wherein the tubular body further comprises an interior circumferential shoulder for engagement to a rotatable latching finger of a seal stem.

8. The apparatus of claim 1 wherein the orientation sleeve is welded to the tubular body.

9. A tubular body adapted for seating in an interior cavity of a tubular sub-assembly of a well control tool, the tubular body comprising:

a hollow interior cavity;

an upper portion adapted for engagement with a lock body; and, a lower portion having two or more orientation grooves comprising one or more guide slopes, wherein the one or more guide slopes are adapted to rotationally align the tubular body when the tubular body is seated in an interior cavity of a tubular sub-assembly of a well control tool having an orientation sleeve having one or more guide slopes that are complementary to the one or more guide slopes of the two or more orientation grooves.

10. The tubular body of claim 9 further comprising one or more orifices adapted to permit fluid communication between the interior cavity and the exterior of the tubular body, wherein at least one of the one or more orifices are adapted to rotationally align with a port of a tubular sub-assembly of a well control tool when the tubular body is seated in an interior cavity of a tubular sub-assembly of a well control tool.

11. The tubular body of claim 9 wherein the upper portion of the tubular body comprises a threaded connector for engagement with a lock body.

12. The tubular body of claim 9 wherein the tubular body further comprises one or more lateral circumferential grooves located along the exterior thereof.

13. The tubular body of claim 12 wherein the tubular body further comprises one or more circular seals located in the lateral circumferential grooves.

14. An apparatus for controlling the flow of oil and/or gas in a production well, the apparatus comprising:

a tubular body having an interior cavity, the tubular body adapted for connection into a tubing string and the tubular body having one or more ports adapted to permit fluid communication between the interior cavity and the exterior of the tubular body;

at least one longitudinal groove on an exterior surface of the tubular body; and, an orientation sleeve coupled to the tubular body, the orientation comprising one or more guide slopes, wherein the one or more guide slopes are adapted to rotationally align a seal stem having complementary guide slopes when a seal stem having complementary guide slopes is seated in the tubular body.

15. The apparatus of claim 14 wherein the longitudinal groove is adapted for locating a cable.

16. An apparatus for controlling the flow of oil and/or gas in a production well, the apparatus comprising:

a tubular body having an interior cavity, the tubular body adapted for connection into a tubing string and the tubular body having one or more ports adapted to permit fluid communication between the interior cavity and the exterior of the tubular body;

one or more lateral circumferential grooves located along the exterior of the tubular body; and, an orientation sleeve coupled to the tubular body, the orientation comprising one or more guide slopes, wherein the one or more guide slopes are adapted to rotationally align a seal stem having complementary guide slopes when a seal stem having complementary guide slopes is seated in the tubular body.

17. An apparatus for controlling the flow of oil and/or gas in a production well, the apparatus comprising:

a tubular body having an interior cavity, the tubular body adapted for connection into a tubing string and the tubular body having one or more ports adapted to permit fluid communication between the interior cavity and the exterior of the tubular body;

an interior circumferential shoulder located along the interior cavity of the tubular body for engagement with a rotatable latching finger of a seal stem; and, an orientation sleeve coupled to the tubular body, the orientation comprising one or more guide slopes, wherein the one or more guide slopes are adapted to rotationally align a seal stem having complementary guide slopes when a seal stem having complementary guide slopes is seated in the tubular body.

18. A tubular body adapted for seating in an interior cavity of a tubular sub-assembly of a well control tool, the tubular body comprising:

a hollow interior cavity;

an upper portion adapted for engagement with a lock body;

a lower portion having one or more orientation grooves comprising one or more guide slopes, wherein the one or more orientation grooves are adapted to rotationally align the one or more circumferential ports of the tubular body when the tubular body is seated in an interior cavity of a tubular sub-assembly of a well control tool having an orientation sleeve having one or more guide slopes that are complementary to the one or more guide slopes of the one or more orientation grooves; and, one or more orifices adapted to permit fluid communication between the interior cavity and the exterior of the tubular body, wherein at least one of the one or more orifices are adapted to rotationally align with a port of a tubular sub-assembly of a well control tool when the tubular body is seated in an interior cavity of a tubular sub-assembly of a well control tool.

19. A tubular body adapted for seating in an interior cavity of a tubular sub-assembly of a well control tool, the tubular body comprising:

a hollow interior cavity;

an upper portion comprising a threaded connection adapted for engagement with a lock body; and, a lower portion having one or more orientation grooves comprising one or more guide slopes, wherein the one or more orientation grooves are adapted to rotationally align the one or more circumferential ports of the tubular body when the tubular body is seated in an interior cavity of a tubular sub-assembly of a well control tool having an orientation sleeve having one or more guide slopes that are complementary to the one or more guide slopes of the one or more orientation grooves.

* * * * *